US009556676B2

(12) United States Patent
Konduc et al.

(10) Patent No.: US 9,556,676 B2
(45) Date of Patent: Jan. 31, 2017

(54) COLLAPSIBLE SUBSTRUCTURE FOR A MOBILE DRILLING RIG

(71) Applicant: National Oilwell Varco, L.P., Houston, TX (US)

(72) Inventors: Kameron Wayne Konduc, Edmonton (CA); Jay John Thiessen, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 14/740,567

(22) Filed: Jun. 16, 2015

(65) Prior Publication Data

US 2015/0300091 A1 Oct. 22, 2015

Related U.S. Application Data

(62) Division of application No. 13/737,199, filed on Jan. 9, 2013, now Pat. No. 9,091,125.

(Continued)

(51) Int. Cl.
*B66C 23/06* (2006.01)
*E21B 7/02* (2006.01)

(Continued)

(52) U.S. Cl.
CPC ..... *E21B 7/023* (2013.01); *E21B 15/00* (2013.01); *E21B 15/003* (2013.01); *E21B 15/04* (2013.01)

(58) Field of Classification Search
CPC .... E04H 12/345; E04H 12/187; E04B 1/3533; E04B 2001/3588; E21B 15/003; E21B 7/023; E21B 15/00

(Continued)

(56) References Cited

U.S. PATENT DOCUMENTS 2,268,796 A 1/1942 Brauer ..... 189/15
2,429,010 A 10/1947 Woolslayer et al. ..... 189/21

(Continued)

FOREIGN PATENT DOCUMENTS

CN 200975216 Y 11/2007
CN 201671551 U 12/2010

(Continued)

OTHER PUBLICATIONS

Brochure entitled "Mobile Rigs," National Oilwell, 8 pp., 2005.

(Continued)

*Primary Examiner* — Basil Katcheves
(74) *Attorney, Agent, or Firm* — Amerson Law Firm, PLLC

(57) ABSTRACT

A collapsible drilling rig substructure is transported to a drilling site while in a collapsed transportation configuration wherein a raisable floor of the substructure is in a lowered transportation position relative to a fixed drill floor such that an upper surface of the raisable floor is positioned at a first height level above a base of the substructure while an upper surface of the fixed drill floor is positioned at a second height level above the base that is greater than the first height level. The substructure is positioned adjacent to a wellbore location at the drilling site and reconfigured from the lowered transportation configuration to a raised operating configuration by raising the raisable floor to an operating position laterally adjacent to the fixed drill floor while maintaining a height level of the upper surface of the fixed drill floor at the second height level.

20 Claims, 16 Drawing Sheets

Related U.S. Application Data

(60) Provisional application No. 61/586,979, filed on Jan. 16, 2012.

(51) Int. Cl.
*E21B 15/00* (2006.01)
*E21B 15/04* (2006.01)

(58) Field of Classification Search
USPC ..... 52/119, 116
See application file for complete search history.

(56) References Cited

U.S. PATENT DOCUMENTS 2,583,072 A 1/1952 Wilson ..... 189/16
2,617,500 A 11/1952 Cardwell ..... 52/115
2,663,375 A * 12/1953 Caldwell ..... E21B 15/00 180/14.1
2,692,031 A 10/1954 Woolslayer et al. ..... 189/21
2,701,039 A 2/1955 Woolslayer et al. ..... 52/292
2,703,634 A 3/1955 Lee ..... 52/115
2,804,948 A 9/1957 Woolslayer et al. ..... 52/118
2,857,993 A 10/1958 Terrell ..... 189/11
2,975,910 A 3/1961 Conrad ..... 212/300
2,993,570 A 7/1961 Bender ..... 52/118
3,033,527 A 5/1962 Hart ..... 254/323
3,109,523 A 11/1963 Moller ..... 52/115
3,156,328 A 11/1964 Bender ..... 189/11
3,201,091 A 8/1965 Woolslayer et al. ..... 51/120 X
3,228,151 A 1/1966 Woolslayer et al. ..... 52/64
3,262,237 A 7/1966 Jenkins et al. ..... 52/116
3,271,915 A * 9/1966 Woolslayer ..... E21B 15/00 52/116
3,333,377 A 8/1967 Woolslayer et al. ..... 52/116
3,340,938 A 9/1967 Wilson ..... 173/28
3,483,933 A * 12/1969 Dyer ..... E21B 15/00 173/39
3,749,183 A 7/1973 Branham et al. ..... 173/151
3,754,361 A 8/1973 Branham et al.
3,807,109 A * 4/1974 Jenkins ..... E21B 15/00 173/151
3,896,887 A 7/1975 Council ..... 173/43
3,922,825 A 12/1975 Eddy et al. ..... 52/116
3,942,593 A * 3/1976 Reeve, Jr. ..... E21B 15/00 173/151
3,981,485 A 9/1976 Eddy et al. ..... 254/186 R
3,987,594 A 10/1976 Rao et al. ..... 52/111
4,005,779 A 2/1977 Andrews ..... 212/87
4,021,978 A 5/1977 Busse et al. ..... 52/118
4,024,924 A 5/1977 Hauck ..... 173/151
4,103,503 A 8/1978 Smith ..... 61/97
4,105,347 A 8/1978 Gossage ..... 403/157
4,135,340 A 1/1979 Cox et al. ..... 52/115
4,138,805 A 2/1979 Patterson ..... 52/118
4,221,088 A 9/1980 Patterson ..... 52/116
4,267,675 A 5/1981 Cochran ..... 52/118
4,269,009 A 5/1981 Lawrence ..... 52/116
4,269,395 A 5/1981 Neuman et al. ..... 254/386
4,290,495 A 9/1981 Elliston ..... 175/85
4,292,772 A 10/1981 Borg et al. ..... 52/118
4,305,237 A 12/1981 Borg et al. ..... 52/116
4,366,650 A 1/1983 Patterson ..... 52/118
4,368,602 A 1/1983 Manten ..... 52/115
4,371,041 A 2/1983 Becker et al. ..... 173/28
4,371,046 A 2/1983 Reed ..... 175/57
4,375,241 A * 3/1983 Gallon ..... E21B 15/00 173/151
4,375,892 A 3/1983 Jenkins et al. ..... 280/43.23
4,438,904 A 3/1984 White ..... 254/311
4,471,587 A 9/1984 Ahmad et al. ..... 52/120
4,478,015 A 10/1984 Lawrence et al. ..... 52/120
4,489,526 A 12/1984 Cummins ..... 52/125.6
4,569,168 A 2/1986 McGovney et al. ..... 52/122.1
4,587,778 A 5/1986 Woolslayer et al. ..... 52/116
4,591,006 A 5/1986 Hutchison ..... 175/52
4,616,454 A 10/1986 Ballachey et al. ..... 52/115
4,630,425 A 12/1986 Reed ..... 52/45.18
4,677,444 A 6/1987 Perek ..... 343/882
4,684,314 A 8/1987 Luth ..... 414/745
4,697,779 A 10/1987 Guislain ..... 248/530
4,757,592 A 7/1988 Reed ..... 29/429
4,769,959 A 9/1988 Lindsey ..... 52/40
4,821,816 A 4/1989 Willis ..... 175/57
4,831,795 A 5/1989 Sorokan ..... 52/120
4,837,992 A 6/1989 Hashimoto ..... 52/118
4,885,893 A 12/1989 Wasterval, Jr. et al. ..... 52/745
4,899,832 A 2/1990 Bierscheid, Jr. ..... 173/23
4,932,175 A 6/1990 Donnally ..... 52/118
5,107,940 A 4/1992 Berry ..... 175/85
5,109,934 A 5/1992 Mochizuki ..... 175/170
5,251,709 A 10/1993 Richardson ..... 175/1
5,342,020 A 8/1994 Stone ..... 254/269
5,425,435 A 6/1995 Gregory ..... 188/77 W
5,709,277 A 1/1998 Geldner ..... 175/203
5,921,329 A 7/1999 Armstrong ..... 175/57
6,029,951 A 2/2000 Guggari ..... 254/269
6,182,945 B1 2/2001 Dyer et al. ..... 254/340
6,474,926 B2 11/2002 Weiss ..... 414/332
6,523,319 B2 2/2003 Bockhorn et al. ..... 52/651.01
6,634,436 B1 10/2003 Desai ..... 173/1
6,848,515 B2 2/2005 Orr et al. ..... 173/1
6,860,337 B1 3/2005 Orr et al. ..... 173/28
6,944,547 B2 9/2005 Womer et al. ..... 702/7
6,951,082 B2 10/2005 Nelson et al. ..... 52/112
6,962,030 B2 11/2005 Conn ..... 52/741.1
6,994,171 B2 2/2006 Orr et al. ..... 173/28
7,155,873 B2 1/2007 Palidis ..... 52/702
7,210,670 B2 5/2007 Franks ..... 254/294
7,246,471 B2 7/2007 Riermann et al. ..... 52/283
7,306,055 B2 12/2007 Barnes ..... 175/57
7,308,953 B2 12/2007 Barnes ..... 175/203
7,357,616 B2 4/2008 Andrews et al. ..... 414/332
7,377,335 B2 5/2008 Jones et al. ..... 175/57
7,413,393 B1 8/2008 Barnes ..... 414/373
7,765,749 B2 8/2010 Palidis ..... 52/112
7,931,076 B2 4/2011 Ditta et al. ..... 166/75.11
7,954,657 B2 6/2011 Holly et al. ..... 212/177
8,047,303 B2 11/2011 Donnally et al. ..... 175/57
8,250,816 B2 8/2012 Donnally et al. ..... 52/123.1
8,414,214 B2 4/2013 Martin ..... 403/85
8,534,474 B2 9/2013 Holly et al. ..... 212/177
8,739,988 B2 6/2014 Walker ..... 212/177
8,813,436 B2 8/2014 Donnally et al. ..... 52/123.1
8,839,966 B2 9/2014 Walker et al. ..... 212/177
2004/0211572 A1 10/2004 Orr et al. ..... 173/1
2004/0211598 A1 10/2004 Palidis ..... 175/162
2004/0212598 A1 10/2004 Kraus et al. ..... 345/168
2004/0240973 A1 12/2004 Andrews et al. ..... 414/332
2005/0193645 A1 9/2005 Barnes ..... 52/120
2005/0194189 A1 9/2005 Barnes ..... 175/122
2005/0236790 A1 10/2005 Carter ..... 280/79.11
2006/0213653 A1 9/2006 Cunningham et al. ..... 166/77.1
2006/0260844 A1 11/2006 Patton et al. ..... 175/52
2008/0066968 A1 3/2008 Landry
2009/0200856 A1 8/2009 Chehade et al. ..... 299/30
2009/0218137 A1 9/2009 Donnally et al. ..... 175/57
2009/0218138 A1 9/2009 Donnally et al. ..... 175/57
2009/0218139 A1 9/2009 Donnally et al. ..... 175/57
2009/0218144 A1 9/2009 Donnally et al. ..... 175/162

FOREIGN PATENT DOCUMENTS

CN 101965435 A 2/2011
CN 102037209 A 4/2011
GB 195862 3/1922
GB 1 478 648 9/1974 ..... F16B 21/00
GB 2 046 332 11/1980
JP 57197322 12/1982 ..... E02D 7/16
JP 57197324 12/1982 ..... E02C 7/20
JP 5976326 5/1984 ..... E02D 7/16
RU 2452844 C1 10/2012
SU 1373786 C1 2/1998

(56) References Cited

FOREIGN PATENT DOCUMENTS

OTHER PUBLICATIONS

Brochure entitled "Ideal™ Rig System," National Oilwell, 8 pp., 2004.
PCT/GB2009/050202 Partial International Search Report and Written Opinion (Jan. 27, 2011).
PCT/GB2009/050202 Partial International Search Report (Aug. 17, 2010).
Office Action from related U.S. Appl. No. 14/016,703 dated Oct. 23, 2014.
PCT Search Report and Written Opinion from PCT/US2012/048030 dated Oct. 16, 2013.
PCT Search Report and Written Opinion from PCT/US2013/020923 dated Feb. 18, 2014.
Chinese Office Action from related application No. 201380005583.0 dated Jan. 10, 2013.
Translation of Russian Decision on Grant dated Sep. 5, 2016 for Russian Patent Application No. 2014133732 filed on Jan. 10, 2013.

* cited by examiner

COLLAPSIBLE SUBSTRUCTURE FOR A MOBILE DRILLING RIG

CROSS-REFERENCE TO RELATED APPLICATIONS

This application is a divisional of U.S. patent application Ser. No. 13/737,199, filed Jan. 9, 2013, which claims priority from U.S. Provisional Patent application Ser. No. 61/586,979, filed on Jan. 16, 2012, and is hereby incorporated by reference for all it contains.

BACKGROUND

1. Field of the Disclosure

The present subject matter is generally directed to mobile drilling rig assemblies, and, in particular, to the use of a collapsible drilling rig substructure to facilitate both highway transportation and drilling site movement of a mobile drilling rig.

2. Description of the Related Art

In many land-based oil and gas drilling operations, drilling rigs are delivered to an oilfield drilling site by transporting the various components of the drilling rig over roads and/or highways. Typically, the various drilling rig components are transported to the drilling site on one or more truck/trailer combinations, the number of which may depend on the size, weight and complexity of the rig. Once at the drilling site, the components are then assembled, and the drilling rig mast is erected to an appropriate operating position. In many applications, the drilling rig mast is raised to a substantially vertical operating position so that drilling operations can be performed so as to drill a wellbore into the earth. For some oil and gas wells, it may be necessary to perform directional drilling operations, such that the drilled wellbore deviates from a substantially vertical orientation to an orientation that is angled to a certain degree from vertical, which in certain applications may even be angled to a substantially horizontal orientation.

In some applications, the target depth of a horizontal leg of a directionally drilled wellbore may be relatively shallow, such as in the range of 300-500 feet, whereas, in other applications, the depth of the horizontal leg may be up to 1500 feet or even deeper. In the case of such near-surface target depths, it may be necessary to initiate the drilling activities at the surface in a non-vertical orientation, i.e., at a non-zero angle relative to horizontal, so that the wellbore can be turned to a substantially horizontal orientation by the time the shallow target depth has been reached. In such cases, specially designed slant rigs may be used, where the drilling rig mast can be adjusted to a specific angle, e.g., at 45° to horizontal, during the drilling operations. Slant rigs can, therefore, provide a marked improvement in near-surface horizontal drilling applications over more traditional land-based oil and gas rigs—i.e., those with a drilling rig mast that is erected to a substantially vertical orientation. However, the relative positioning of the various slant rig components during drilling operations can lead to certain problems and/or inefficiencies during highway and/or road transportation of the slant rig components between oilfield sites, assembly and erection of the slant rig and movement of the assembled slant rig between adjacent wellbores during pad drilling.

FIGS. 1A-1E illustrate one representative prior art mobile drilling rig that has been used for slant rig drilling applications. More specifically, FIG. 1A shows a drilling rig mast assembly structure 120 positioned on a trailer 101, which is pulled by a truck 100 over a highway and/or road surface 105. The trailer 101 is supported by a plurality of wheels 102, the quantity of which may vary depending on the size and/or weight of the mast assembly structure 120. The mast assembly structure 120 includes a drilling mast 110 with a crown block assembly 111 located at an upper end thereof to facilitate movement of a top drive assembly 125 during drilling operations. The mast assembly structure 120 also typically includes one or more hydraulic cylinders 124 that are used for erecting the drilling mast 110 to a desired operating position, e.g., at a 45° angle relative to horizontal, by pivoting the mast 110 about a pinned connection 115. Furthermore, as shown in FIG. 1A, a stiff leg 121 (see, FIG. 1E) is transported in two sections—a lower section 121*a* that is pivotably connected to the trailer 101, and an upper section 121*b* that will be connected at its lower end to the lower section 121*a* and at its upper end to the drilling rig mast 110 after erection so as to support the mast 110 at an appropriate angle. Additionally, the mast assembly structure 120 includes connections 122*a*, 122*b* to which a rig substructure 160 (see, FIGS. 1B-1E) will be connected during assembly of the slant rig 195 (see, FIGS. 1D and 1E).

FIGS. 1B and 1C show the rig substructure 160 positioned on a trailer 151, which is pulled by a truck 150 over the highway and/or road surface 105. The trailer 151 is supported by a plurality of wheels 152, the quantity of which varies depending on the size and/or weight of the rig substructure 160. The rig substructure 160 includes a plurality of structural members 165 and bearing pad support beams 161 for supporting the dead and operating loads of the slant rig 195 (see, FIGS. 1D and 1E). Additionally, the rig substructure 160 includes connections 162*a*, 162*b* which can be connected to connections 122*a*, 122*b* of the mast assembly structure 120 (see, FIG. 1A) during rig assembly. As shown in FIG. 1B, the rig substructure 160 supports a drawworks 170, and, during transportation, also may support the wellhead equipment 190, e.g., a Christmas tree, blowout preventer (BOP), etc., as shown in FIG. 1C.

FIG. 1D shows the slant rig 195 after the rig substructure 160 has been positioned on drilling mats 180, which are placed on the surface 181 of the well site to support the slant rig 195 and other auxiliary drilling equipment (not shown) during drilling operations. Furthermore, the mast assembly structure 120 has been raised so that the connections 162*a* and 162*b* can be fastened to the connections 122*a* and 122*b*, respectively, on the mast assembly structure 120. Additionally, the drilling rig mast assembly structure 120, including the trailer 101, is supported by a plurality of jacks 130 and/or similar structural supports, the quantity and position of which may depend on the size and weight of the mast assembly structure 120.

FIG. 1E shows the slant rig 195 after the mast 110 has been erected to an appropriate angle for near-surface direction drilling, e.g., at an angle of 45° relative to horizontal. Additionally, the upper and lower sections 121*b*, 121*a* of the stiff legs 121 have been assembled so as to support the mast 110, and a drilling line 171 has been sheaved from the drawworks 170 and over the crown block 111 to support the top drive 125 during drilling operations. Furthermore, the wellhead equipment 190 is now positioned in the cellar 191, i.e., the area within the substructure 160 and below the drill floor 163.

In the rig configuration illustrated in FIG. 1E, the drawworks 170 is in a "low" position, such that it is located below the drill floor 163. However, it should be appreciated that the wellhead equipment 190 is effectively contained within a substantially "closed" cellar 191—i.e., one that is enclosed on all four sides: by the mast assembly structure 120 and trailer 101 on the front side, by the structural members 165 of the rig substructure 160 on both the driller's side and the off-driller's side, and by the drawworks 170 on the back side. As such, access to the wellhead equipment 190 for repair and/or maintenance activities during the drilling operations is restricted due to the substantially "closed" cellar 191. Additionally, it should be appreciated that the slant rig 195 cannot be moved from the current wellbore location without first disassembling the respective connections 122*a*, 122*b* and 162*a*, 162*b*, and then moving the mast assembly structure 120 and the rig substructure 160 away from wellhead equipment 190 in opposite directions. Accordingly, the slant rig 195 shown in FIG. 1E is not easily adapted for use in pad drilling operations, i.e., where multiple adjacent and/or closely-spaced wellbores are drilled at the same site location, as moving the slant rig 195 requires that the rig 195 be disassembled, the components moved on separate trailers, and then reassembled at a new wellbore location.

FIGS. 2A-2D illustrate yet another representative prior art mobile drilling rig that has been used for slant rig drilling applications. As shown in FIG. 2A, a drilling rig mast assembly structure 220 is positioned on a trailer 201 that is supported by a plurality of wheels 202, and which is pulled by a truck 200 over a highway and/or road surface 205. The mast assembly structure 220 includes a drilling mast 210 with a crown block assembly 211 located at an upper end thereof to facilitate movement of a top drive assembly (not shown) during drilling operations. The mast assembly structure 220 also typically includes a pair of hydraulic cylinders 224 that are used for erecting the drilling mast 210 to a desired operating position, e.g., at a 45° angle relative to horizontal, by pivoting the mast 210 about a pinned connection 215. Furthermore, the mast assembly structure 220 also includes a stiff leg 221 that is pivotably connected to the trailer 201 for supporting the drilling rig mast 210 after erection to an appropriate angle.

The mast assembly structure 220 also includes a rig substructure 260 having a drill floor 263, as well as a plurality of structural members 265 and bearing pad support beams 261 for supporting the dead and operating loads of the fully assembled slant rig 295 (see, FIG. 2D) during drilling operations. Additionally, the rig substructure 260 has connections 222*a*, 222*b* to which a drawworks box 270*b* (see, FIGS. 2B-2D) can be connected during assembly of the slant rig 295. As shown in FIG. 2A, a cellar area 291*a* of the substructure 260 is located below the drill floor 263.

FIG. 2B shows a truck 250 that is used to pull a trailer 251 over the highway and/or road 205. The trailer 251 supports a drawworks 270 mounted on a drawworks skid 270*a*, and the drawworks box 270*b*. The drawworks box 270*b* includes a plurality of structural members 275 and a floor 263*b*, as well as connections 262*a* and 262*b* for fastening the drawworks box 270*b* to connections 222*a* and 222*b*, respectively, on the rig substructure 260 (see, FIG. 2A). A cellar area 291*b* is located below the floor 263*b* of the drawworks box 270*b*, which is enclosed on two sides by the structural members 275. FIG. 2C is an end view of the drawworks box 270*b*, and shows that the cellar area 291*b* is substantially open between the structural members 275.

FIG. 2D shows the slant rig 295 after the connections 262*a* and 262*b* on the drawworks box 270*b* have been fastened to the connections 222*a* and 222*b*, respectively, on the rig substructure 260, and after the drawworks skid 270*a* with the drawworks 270 thereon have been positioned on the floor 263*b* of the drawworks box 270*b*. Unlike the slant rig 195 illustrated in FIG. 1E and described above, the drawworks 270 of the slant rig 295 is in a "high" position, i.e., substantially at the level of the drill floor 263*a*. In this assembled configuration, the cellar 291 of the slant rig 295 (which is now made up of the cellar area 291*a* of the rig substructure 260 and the cellar area 291*b* of the drawworks box 270*b*) is enclosed on three sides: by the rig assembly 220 and the trailer 201 on the front side, and by the structural members 265 and 275 on the driller's side and off-driller's side. The cellar 291 is open, however, from the back side of the slant rig 295. The slant rig 295 can, therefore, be moved away from a first wellbore location after drilling operations have been completed by using the truck 200 to move the trailer 201 over the surface 281 of the drilling site and away from the first wellbore location, and thereafter positioned at a second nearby wellbore location. As such, the slant rig 295 shown in FIG. 2D is more readily adaptable for pad drilling operations than the slant rig 195 illustrated in FIGS. 1A-1E.

However, it should be appreciated that, due to the fixed structure of the drawworks box 270*b*, the height at which the drawworks box 270*b* must be attached to the rig substructure 260, and the relatively high weight of the drawworks 270 (which may be as much as 30,000 pounds or even greater), the drawworks box 270*b* and the drawworks 270 must be assembled to the mast assembly structure 220 by using a suitably sized crane (not shown). Furthermore, due to typical height and/or weight restrictions on permits for highway and/or road transportation of heavy equipment, the drawworks box 270*b* and drawworks 270 usually cannot be transported by the truck 200 and trailer 201 over highways and/or roads in the fully assembled configuration shown in FIG. 2D. As such, a crane must also be used to disassemble the slant rig 295 after the drilling operations at a given pad drilling site have been completed. Accordingly, logistical considerations for using the slant rig 295 in pad drilling operations must include having a crane present at a given pad drilling site prior to the commencement of drilling operations in order to facilitate initial rig assembly. Furthermore, a crane must also be present after the completion of pad drilling operations so as to facilitate rig disassembly for transportation to other pad drilling sites. As may be appreciated, the requirement that a crane be used during these stages can have a significant impact on the overall cost of the drilling operation, as well as the amount of time that may be needed to perform the operations.

Accordingly, there is a need to develop and implement new designs and methods for facilitating the transportation of a mobile drilling rig, such as a slant drilling rig and the like, between various drilling sites without relying on the use of a crane to assemble and disassemble the rig, as well as enabling the mobile drilling rig to be moved between adjacent wellbore locations during pad drilling operations without first disassembling the rig.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the present disclosure is directed to methods for raising and using a collapsible substructure of a mobile drilling rig. In one illustrative embodiment, a method includes transporting a collapsible drilling rig substructure to a drilling site while the collapsible drilling rig substructure is in a collapsed transportation configuration, wherein a raisable floor of the collapsible drilling rig substructure is in a lowered transportation position relative to a fixed drill floor of the collapsible drilling rig substructure such that an upper surface of the raisable floor is positioned at a first height level above a base of the collapsible drilling rig substructure while an upper surface of the fixed drill floor is positioned at a second height level above the base that is greater than the first height level. Furthermore, the disclosed method includes positioning the collapsible drilling rig substructure adjacent to a wellbore location at the drilling site, and reconfiguring the collapsible drilling rig substructure from the lowered transportation configuration to a raised operating configuration, wherein reconfiguring the collapsible drilling rig substructure includes raising the raisable floor from the lowered transportation position to an operating position laterally adjacent to the fixed drill floor while maintaining a height level of the upper surface of the fixed drill floor at the second height level above the base.

In another exemplary embodiment, a method is disclosed that includes positioning a raisable floor of a drilling rig substructure in a lowered transportation position relative to a fixed drill floor of the drilling rig substructure such that an upper surface of the raisable floor is positioned at a first height level above a base of the drilling rig substructure while an upper surface of the fixed drill floor is positioned at a second height level above the base that is greater than the first height level. Additionally, a drawworks is positioned on the raisable floor of the drilling rig substructure while the raisable floor is in the lowered transportation position, and the drilling rig substructure is transported with the drawworks positioned on the raisable floor to a drilling site while the raisable floor is in the lowered transportation position and positioned adjacent to a wellbore location at the drilling site. Furthermore, the raisable floor is raised with the drawworks positioned thereon from the lowered transportation position to an operating position adjacent to the fixed drill floor such that the upper surface of the raisable floor is at an operating height level above the base for performing drilling operations that is substantially the same as the second height level of the upper surface of the fixed drill floor.

BRIEF DESCRIPTION OF THE DRAWINGS

The disclosure may be understood by reference to the following description taken in conjunction with the accompanying drawings, in which like reference numerals identify like elements, and in which:

FIG. 3I is an overall side elevation view of the slant rig assembly of FIG. 3H, wherein the drilling rig mast is set at an angled orientation;

Figure 1A:
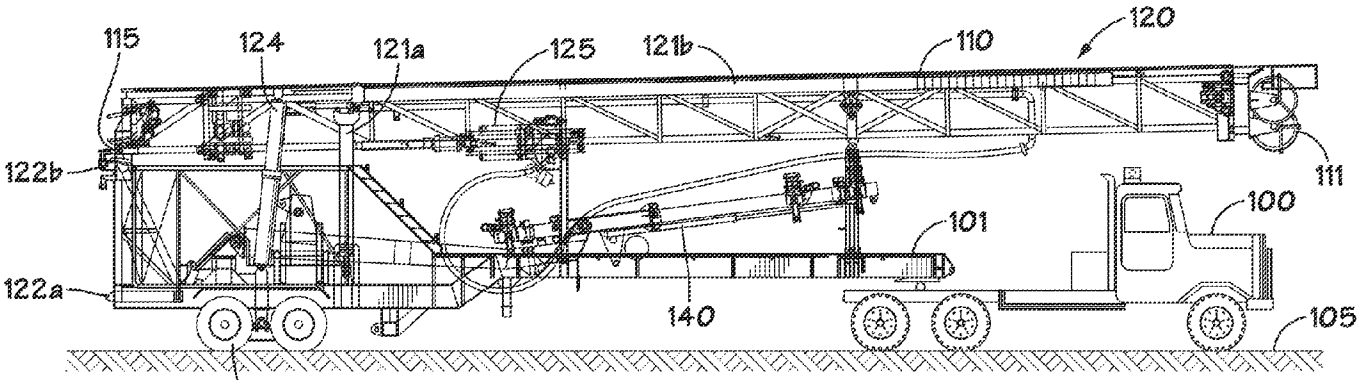
FIG. 1A (PRIOR ART)
FIG. 1A is a side elevation view of a mast assembly structure of a representative prior art slant rig, wherein the mast assembly structure is positioned on a trailer for highway and/or road transportation.
Figure 1C:
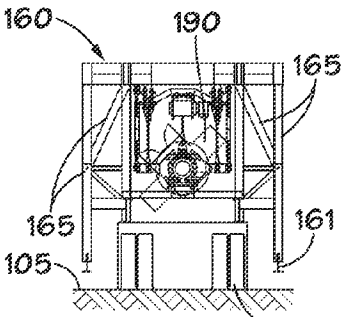
FIG. 1C (PRIOR ART)
FIG. 1C is an end elevation view of the rig substructure of FIG. 1B.
Figure 1B:
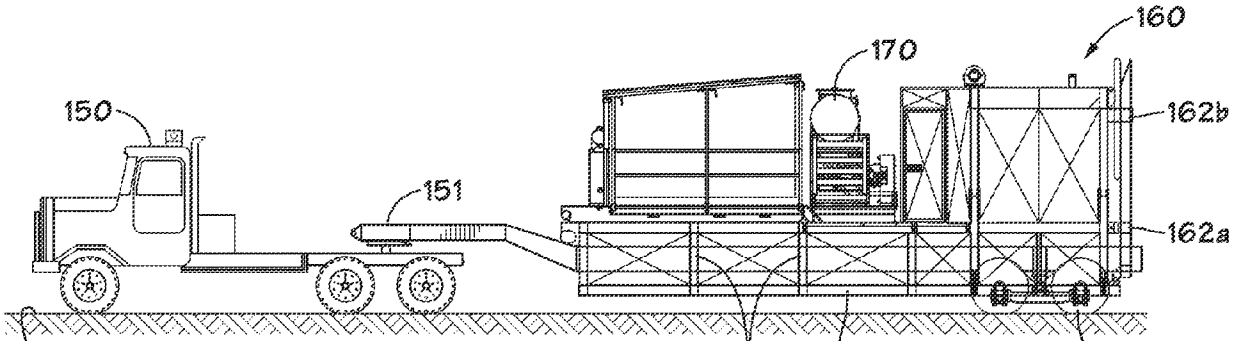
FIG. 1B (PRIOR ART)
FIG. 1B is a side elevation view of a rig substructure of the prior art slant rig of FIG. 1A, wherein the rig substructure is positioned on a trailer for highway and/or road transportation.
Figure 1D:
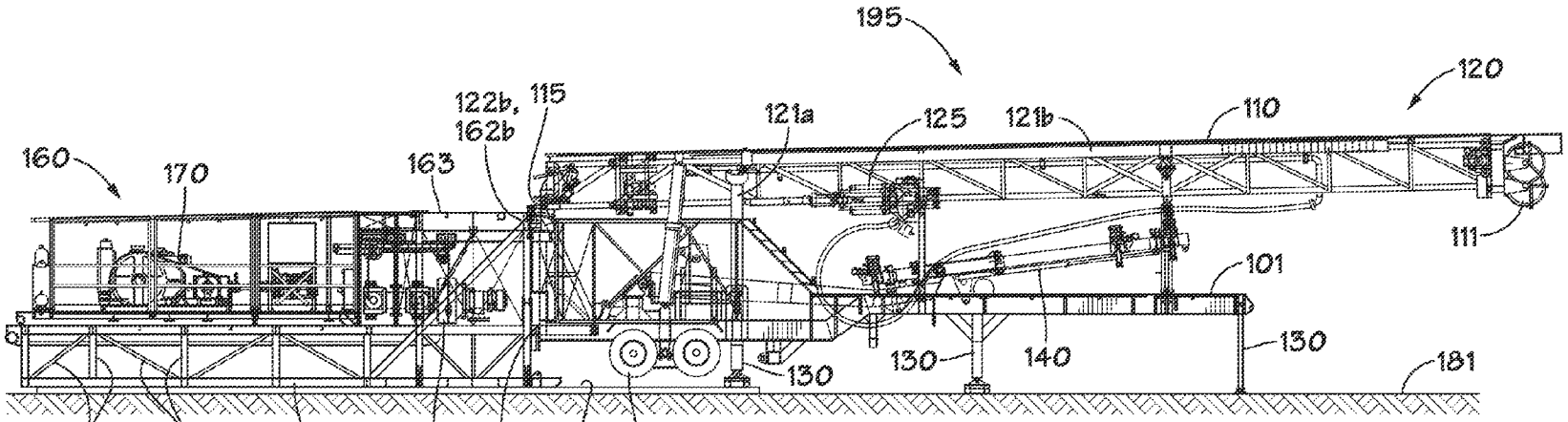
FIG. 1D (PRIOR ART)
FIG. 1D is a side elevation view of the prior art slant rig of FIGS. 1A-1C, after full assembly of the rig substructure of FIGS. 1B and 1C to the mast assembly structure of FIG. 1A.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the subject matter disclosed herein relates to a collapsible drilling rig substructure that is adapted to lower at least a portion of the substructure when a drawworks is positioned thereon to a "low" transportation position for highway and/or road transportation to an oilfield drilling site. The collapsible rig substructure may be further adapted to raise at least a portion of the substructure with the drawworks positioned thereon to a "high" operating position after the substructure has been assembled with a drilling rig mast assembly structure so as to thereby facilitate drilling operations. Additionally, the collapsible rig substructure may also be adapted so that at least a portion of the substructure can be retracted after drilling operations have been completed and while the drawworks remain positioned in the "high" operating position, so as to enable movement of the fully assembled drilling rig between adjacent wellbore locations of a pad drilling site. Furthermore, the collapsible drilling rig substructure may be further adapted so that at least a portion of the substructure with the drawworks positioned thereon may be raised or lowered to an "intermediate" movement position while the collapsible rig substructure is either being transported on a highway and/or road to an oilfield drilling site, or being moved around within the oilfield drilling site between different wellbore locations.

FIGS. 3A-3M, which depict various elements of an illustrative collapsible substructure of a mobile drilling rig of the present disclosure, are described in detail below, together with methods of assembling and moving the same.

Figure 3A:
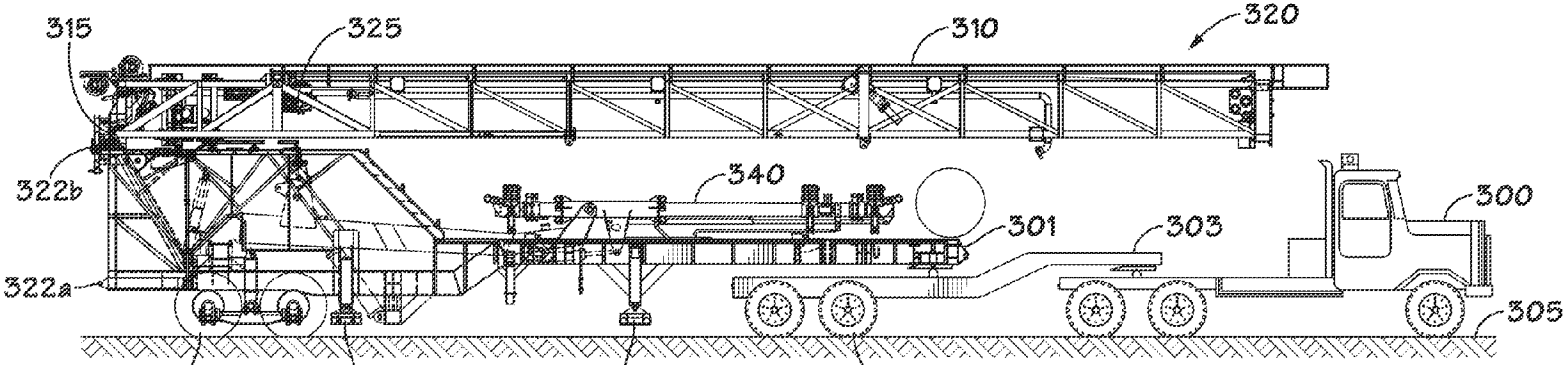
FIG. 3A is a side elevation view of a mast assembly structure of one embodiment of a mobile drilling rig disclosed herein, wherein the mast assembly structure is positioned on a trailer for highway and/or road transportation.

FIG. 3A shows a drilling rig mast assembly structure 320 of an illustrative mobile drilling rig of the present disclosure, wherein the mast assembly structure 320 is positioned on a trailer 301. In some embodiments, the trailer 301 is adapted to be pulled by a truck 300 over a highway and/or road surface 305. The trailer 301 may be supported by a plurality of wheels 302, the quantity of which may vary depending on the size and/or weight of the mast assembly structure 320. Additionally, in certain embodiments, an intermediate trailer, or "jeep," 303 with a plurality of wheels 304 may be positioned between the truck 300 and the trailer 301 when the weight of the mast assembly structure 320 and/or the maximum load capacity of the road 305 may dictate. The mast assembly structure 320 may include a drilling mast 310 that is pivotably mounted on a pinned connection 315, about which the drilling mast may be pivotably rotated to various different positions, depending on the specific operation.

For example, during some operations, such as road transportation of the mast assembly structure 320 to or between oilfield drilling sites, the drilling mast 310 may be positioned in a substantially horizontal transportation orientation, as shown in FIG. 3A. Furthermore, the drilling mast 310 may be raised to an appropriate orientation in preparation for performing other operations, such as drilling operations and the like. For example, a mast raising apparatus 324 (see, FIGS. 3K and 3L), such as a hydraulic or pneumatic cylinder and the like, may be used to erect the drilling mast 310 to a desired operating position—e.g., at an angled orientation, such as 45°, relative to horizontal in the case of slant rig operations (see, FIG. 3I), or at a substantially vertical orientation (see, FIG. 3H)—by pivotably rotating the mast 310 about the pinned connection 315. Additionally, the mast 310 may also be lowered to the substantially horizontal transportation orientation shown in FIG. 3A during movement of an assembled mobile drilling rig 395 (see, FIGS. 3K and 3L) between various wellbore locations of a pad drilling site, as will be further described below.

Figure 3B:
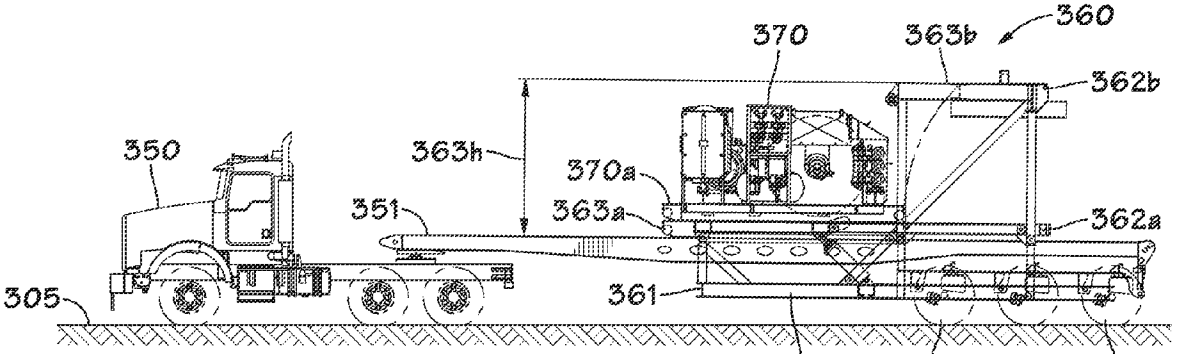
FIG. 3B is a side elevation view of one embodiment of a collapsible rig substructure of the present disclosure with a drawworks positioned thereon, wherein the collapsible rig substructure is positioned on a trailer for highway and/or road transportation.
Figure 3C:
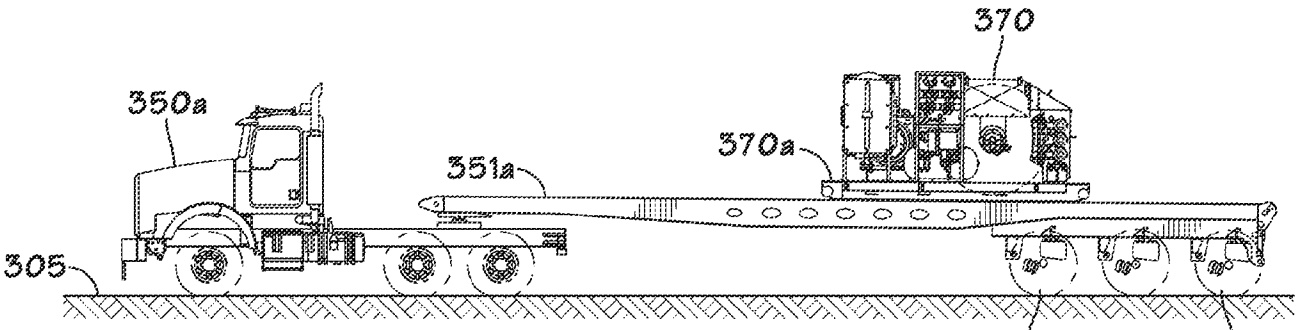
FIG. 3C is a side elevation view of a drawworks of the present disclosure positioned on a trailer for highway and/or road transportation.
Figure 3D:
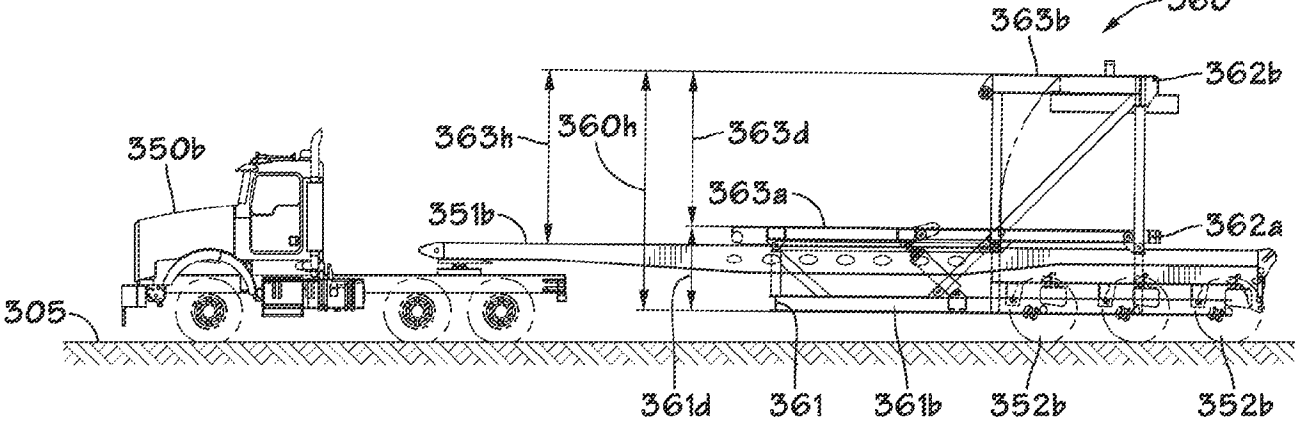
FIG. 3D is a side elevation view of an illustrative embodiment of the collapsible rig substructure disclosed herein positioned on a trailer for highway and/or road transportation.
Figure 3E:
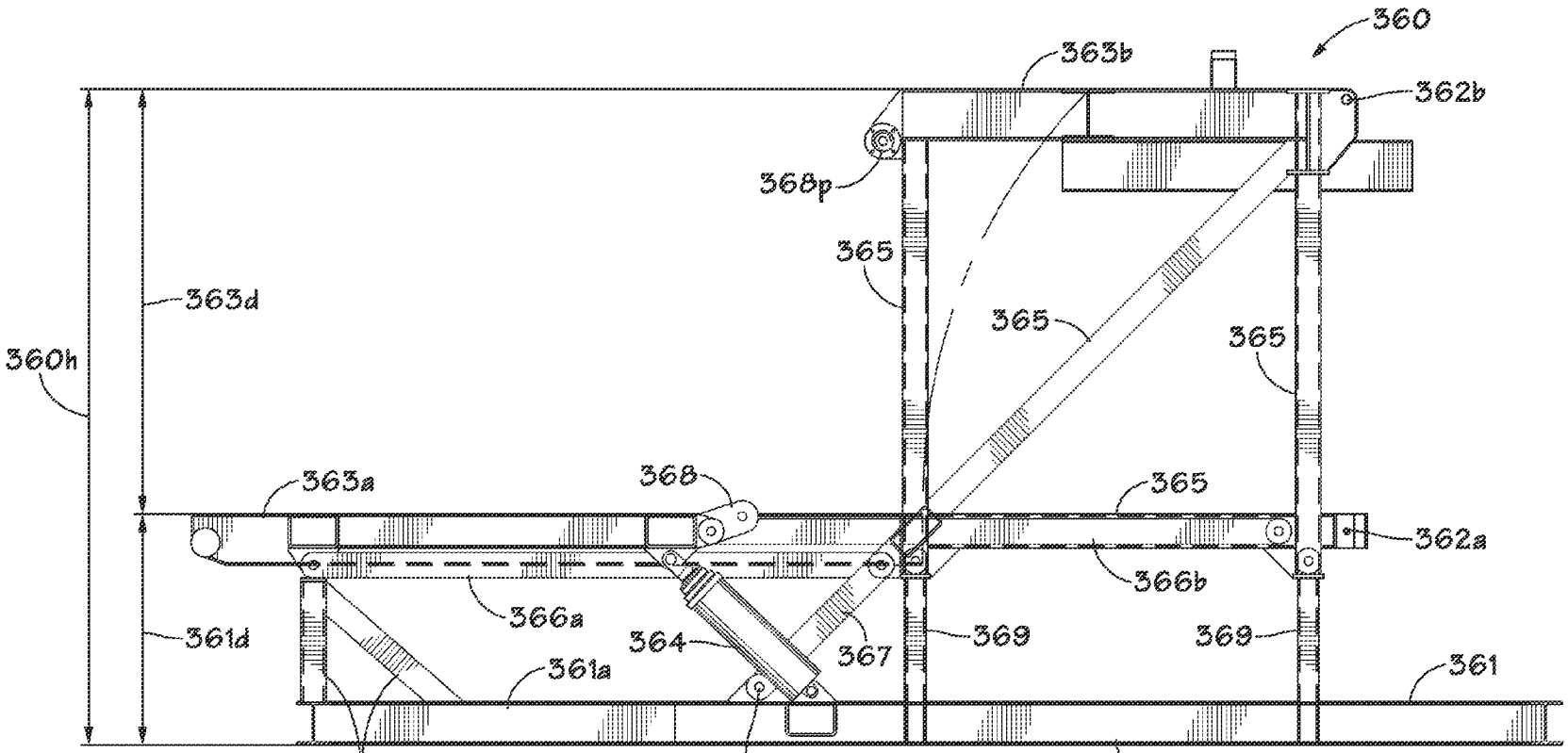
FIG. 3E is a close-up side elevation view of an illustrative collapsible rig substructure of the present disclosure.
Figure 3F:
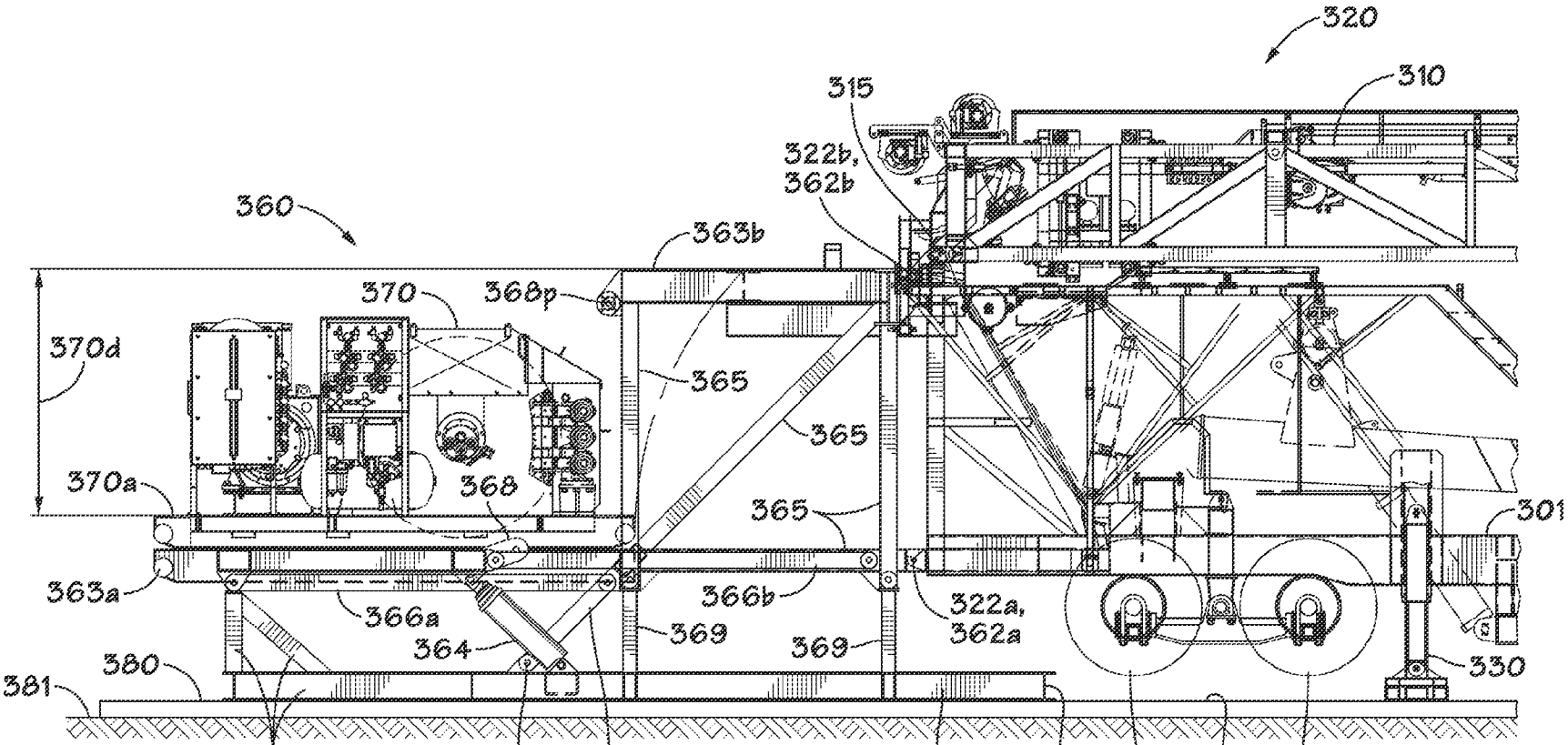
FIG. 3F is a close-up side elevation view of the collapsible rig substructure and drawworks of FIG. 3B, wherein the collapsible rig substructure is attached to the mast assembly structure of FIG. 3A.
Figure 3G:
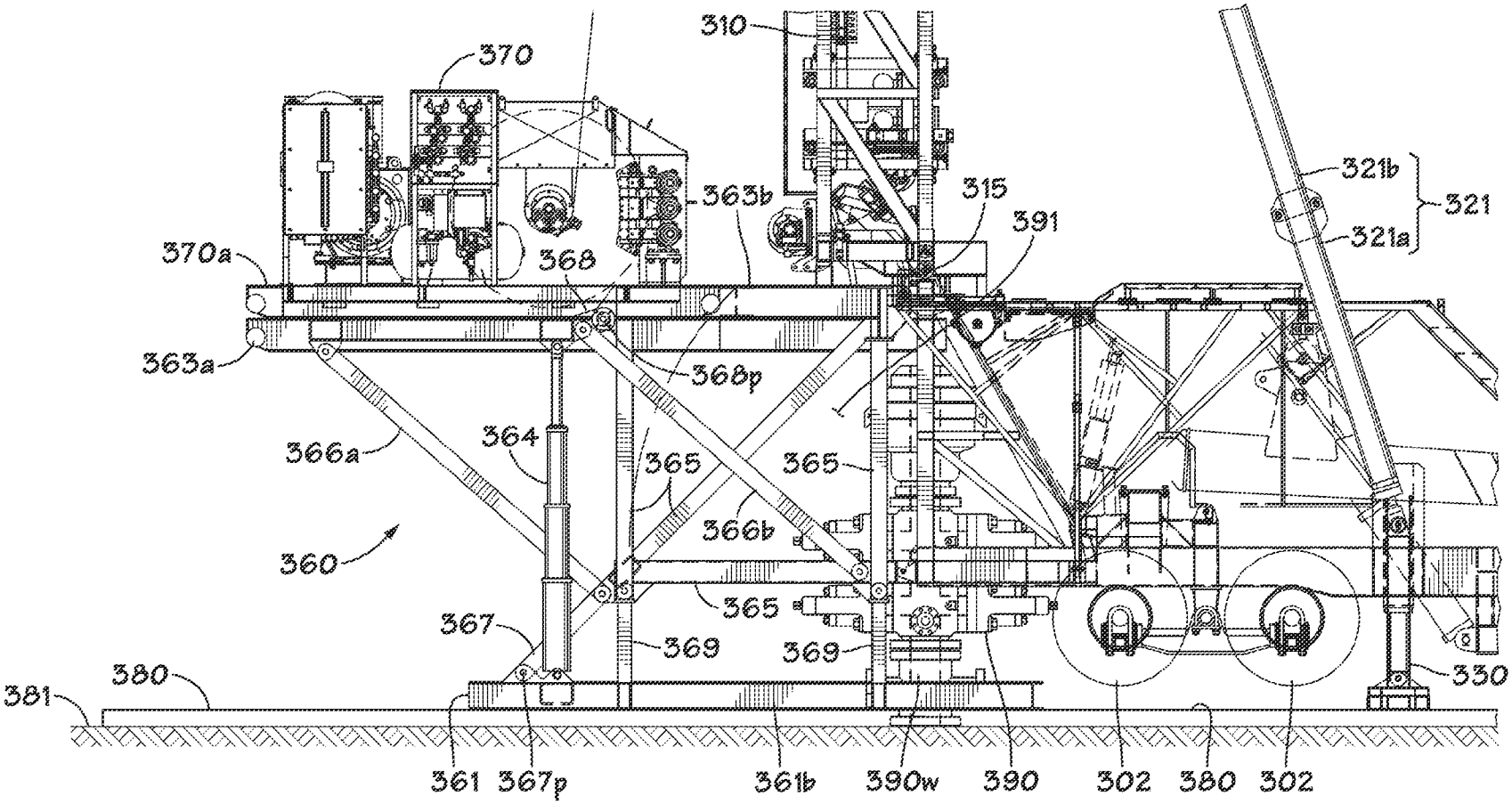
FIG. 3G is a close-up side elevation view of the collapsible rig substructure and drawworks of FIG. 3F, after the drawworks has been raised to an operating position.
Figure 3H:
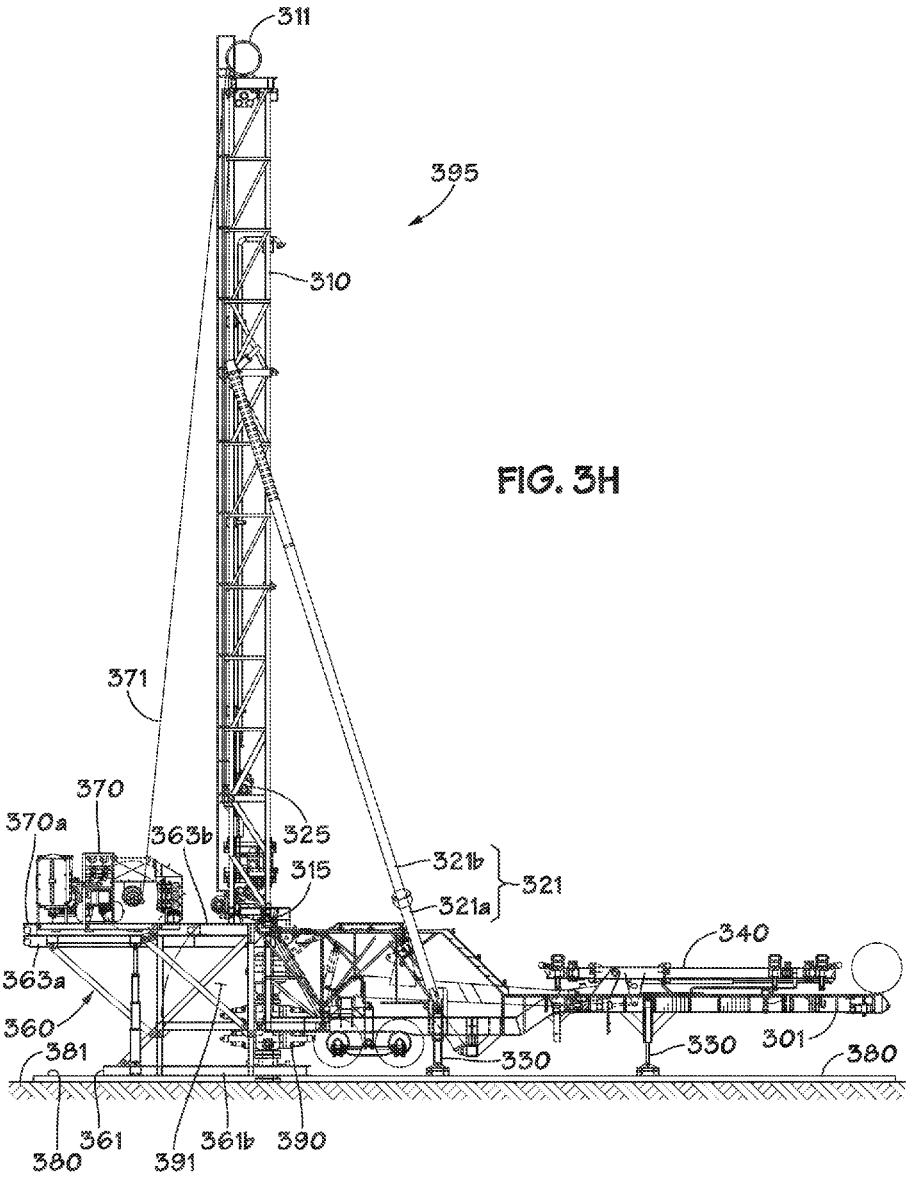
FIG. 3H is an overall side elevation view of an illustrative slant rig assembly with the collapsible rig substructure and drawworks of FIG. 3G, wherein the drilling rig mast is set at a substantially vertical orientation.
Figure 31:
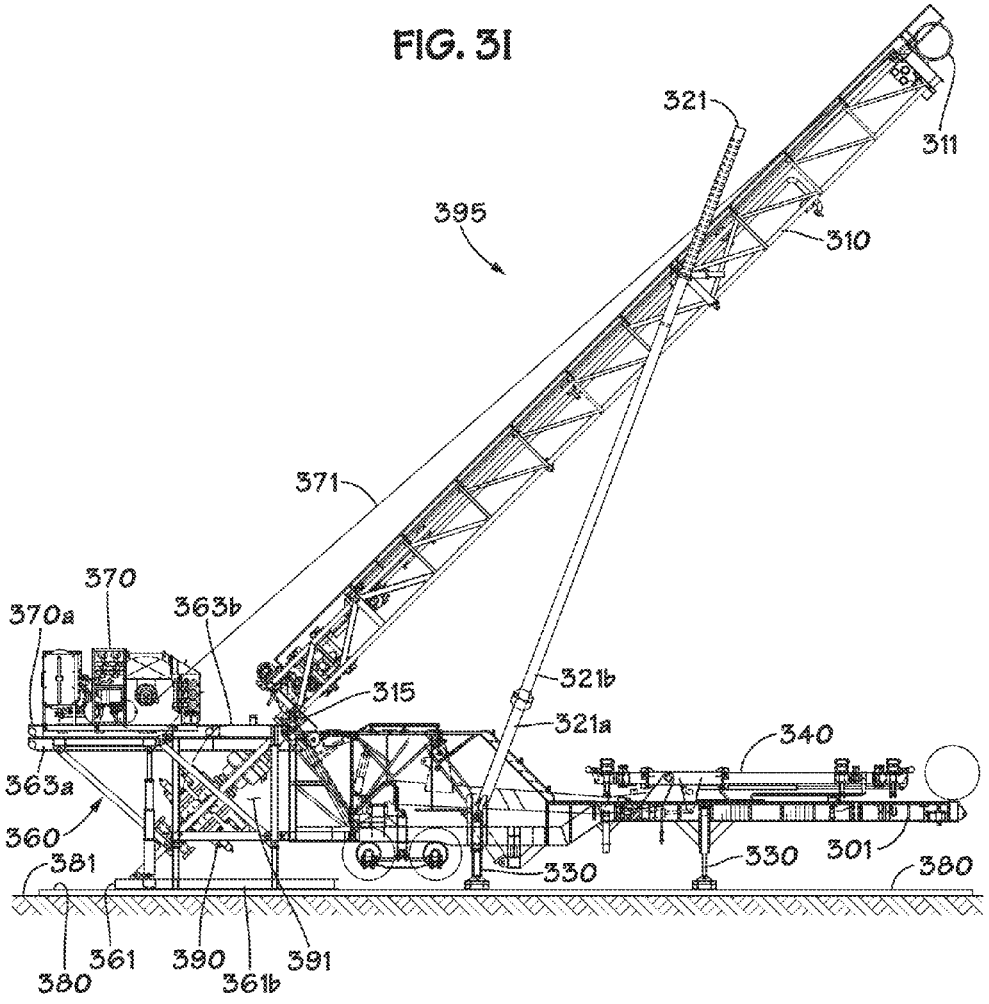

In some embodiments, the mast assembly structure 320 may also include lower connections 322*a* and upper connections 322*b* to which a collapsible rig substructure 360 (see, FIGS. 3B and 3D-3E) may be releasably coupled during the assembly of the mobile drilling rig 395 (see, FIGS. 3H and 3I). Furthermore, in certain illustrative embodiments, the mast assembly structure 320 may include a plurality of support jacks 330 and/or similar structural support members that may be adapted to raise, level and/or support the trailer 301 during drilling operations (see, FIGS. 3F-3I).

FIG. 3B shows an illustrative collapsible rig substructure 360 of the present disclosure positioned on a trailer 351, which may be pulled by a truck 350 over the highway and/or road surface 305. In certain embodiments, the collapsible rig substructure 360 may include, among other things, a raisable floor 363*a* and a fixed drill floor 363*b*, as well as a base 361 that is adapted to support the fully assembled mobile drilling rig 395 (see, FIGS. 3G-3I) during drilling operations, and which may include one or more bearing pad support beams 361*b*. Furthermore, the upper surface of the fixed drill floor 363*b* may be positioned at an operating height 360*h* (see, FIGS. 3D-3E) above the base 361, and the height 360*h* may depend on the specific design parameters of the mobile drilling rig 395 (see, FIGS. 3H and 3I). For example, in certain exemplary embodiments, the overall operating height 360*h* of the collapsible rig substructure 360 may be in the range of approximately 10-20 feet, whereas, in at least one representative embodiment, the height 360*h* may be around 13 feet. Furthermore, the overall operating height 360*h* may be as great as about 25 feet or more. Additionally, in some illustrative embodiments, a drawworks skid 370*a* may be positioned on the raisable floor 363*a*, and a drawworks 370 may be positioned on the drawworks skid 370*a* during transportation.

As shown in FIG. 3B, the raisable floor 363*a* is depicted in a lowered transportation position, such that the upper surface of the raisable floor 363*a* is positioned at a height level that is above the bearing pad support beams 316*b* of the base 361 by a distance 361*d* and below the height level of the upper surface of the fixed drill floor 363*b* by a distance 363*d* (see, FIGS. 3D-3E). Additionally, the collapsible rig substructure 360 may be positioned on the trailer 351 in such a way that the bearing pad support beams 361*b* hang over the sides, and below the floor, of the trailer 351, thereby reducing a height 363*h* that the fixed drill floor 363*b* may be located above the floor level of the trailer 351. In this configuration, the collapsible rig substructure 360 may, therefore, be transported with the drawworks skid 370*a* and drawworks 370 positioned thereon over the highway 305 while minimizing, or even eliminating, the impact of any height clearance restrictions during transportation. As may be appreciated, the relative height level position of the upper surface of the raisable floor 363*a* with respect to the upper surface of the fixed drill floor 363*b* and the bearing pad support beams 361*b* (i.e., the relative distances 363*d* and 361*d*, respectively) when the raisable floor 363*a* is in the lowered transportation position may depend on several factors. For example, the distances 363*d* and 361*d* during road transportation of the collapsible rig substructure 360 may depend upon the weight of the drawworks 370 and drawworks skid 370*a*, the overall height 360*h* of the substructure 360, and the specific overhead clearance requirements for highway and/or road transportation, and the like. In certain embodiments, the distance 363*d* that the raisable floor 363*a* is positioned below the fixed drill floor 363*b* during road transportation may in the range of approximately 7-14 feet, whereas, in at least one representative embodiment, the distance 363*d* may be on the order of about 8-9 feet. Moreover, in some illustrative embodiments, the distance 363*d* may range up to approximately 17 feet or more.

In some illustrative embodiments, the collapsible rig substructure 360 may also include lower connections 362*a* and upper connection 362*b* that are adapted to be releasably coupled to the respective connections 322*a* and 322*b* of the mast assembly structure 320 (see, FIG. 3A) during assembly of the mobile drilling rig 395 (see, FIGS. 3H and 3I). Furthermore, it should be appreciated that the trailer 351 may be supported by a plurality of wheels 352, the quantity of which may vary depending on the size and/or weight of the collapsible rig substructure 360 and any ancillary equipment included therewith, such as the drawworks skid 370*a* and drawworks 370 noted above.

FIGS. 3C-3D show an optional method for transporting the collapsible rig substructure 360 and the drawworks 370 in those instances where the combined weight of the substructure 360 and the drawworks 370 may exceed maximum road/highway weight limitations. As shown in FIG. 3C, the drawworks 370 may be positioned on the drawworks skid 370*a*, and both may thereafter be positioned on a trailer 351*a* and transported by a truck 350*a* over the highway 305 without the collapsible rig substructure 360. Similarly, the collapsible rig substructure 360 may be positioned on a trailer 351*b* and transported by a truck 350*b* over the highway 305 without the drawworks 370 and the drawworks skid 370*a*. Once the truck/trailer combinations 350*a*/351*a* and 350*b*/351*b* reach a designated pad drilling site, the collapsible rig substructure 360 may be off-loaded from the trailer 351*b* to drilling mats 380 (see, FIG. 3F). Thereafter, the drawworks skid 370*a* and drawworks 370 may be offloaded from the trailer 351*a* to the raisable floor 363*a* of the collapsible rig substructure 360 in a typical manner known in the art. For example, in certain embodiments, the floor of the trailer 351*a* may be substantially aligned with the raisable floor 363*a*, and the drawworks skid 370 may then be moved by dragging/sliding the skid 370 from the trailer 351*a* to the raisable floor 363*a* using tuggers and/or winches until the skid 370 has been moved to the position illustrated in FIG. 3F.

Figure 3J:
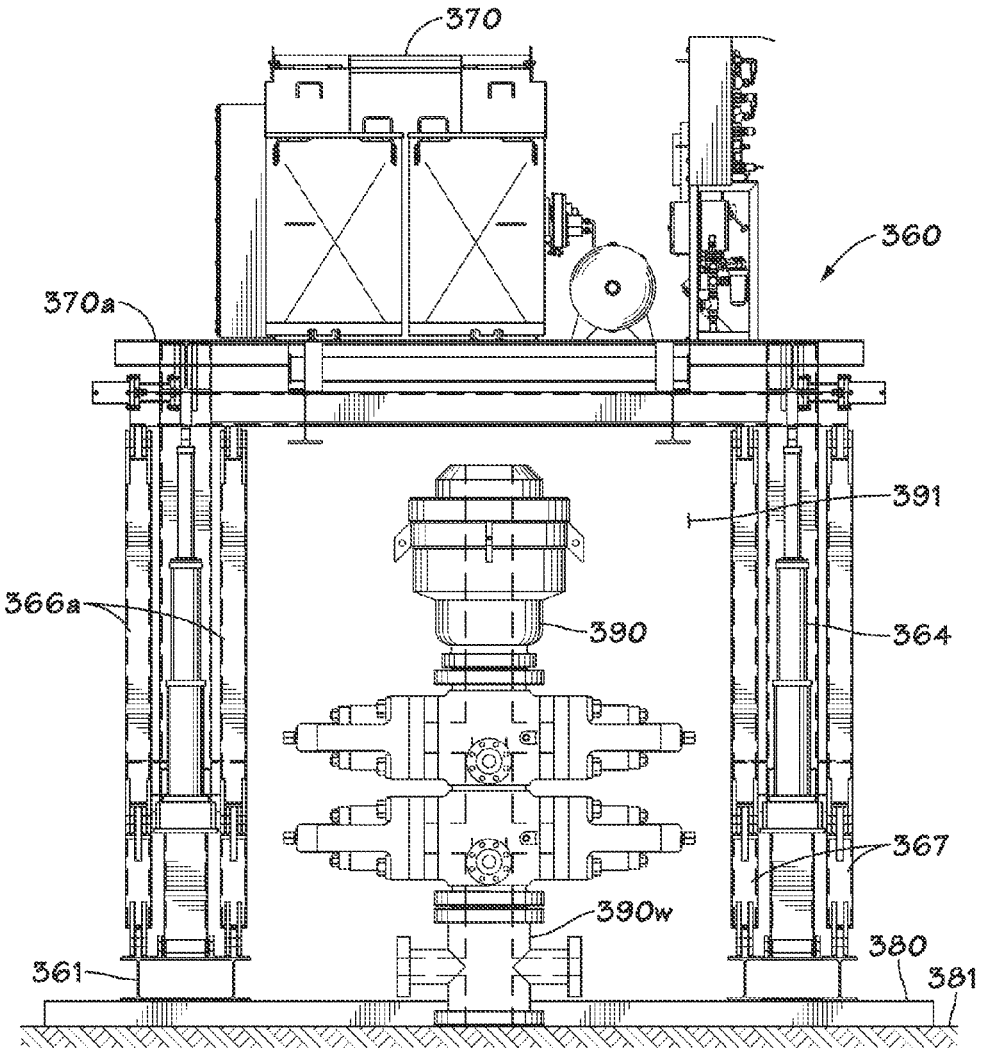
FIG. 3J is an end elevation view of the collapsible rig substructure of FIG. 3G.
Figure 3K:
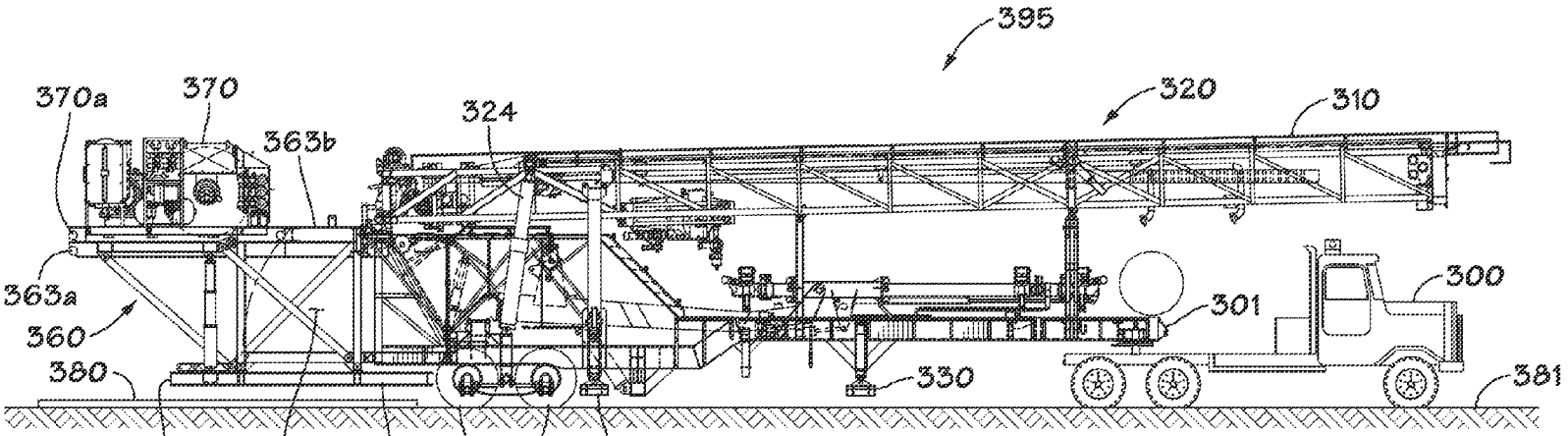
FIG. 3K is a side elevation view of one illustrative embodiment of a mobile drilling rig disclosed herein, after the bearing pad support beams of the collapsible rig substructure have been retracted to enable movement of the assembled mobile drilling rig between wellbore locations.

FIG. 3E provides a close-up side elevation view of an illustrative embodiment of the collapsible rig substructure 360 disclosed herein. As shown in FIG. 3E, the collapsible rig substructure 360 is supported by a base 361 that includes one or more bearing pad support beams 361*b* and includes a raisable floor 363*a* (shown in FIG. 3E in a substantially fully lowered transportation position) and a fixed drill floor 363*b*. The fixed drill floor 363*b* may be supported by a plurality of structural members 365 and 369 that connect the fixed drill floor 363*b* to the base 361. The collapsible rig substructure 360 may also include a raising apparatus that is operatively coupled to the raisable floor 363*a*, which is adapted to raise and lower the raisable floor 363*a* between the lowered transportation position (as shown, for example, in FIGS. 3B and 3D-3F) and a raised operating position (as shown, for example, in FIGS. 3G-3I). In some illustrative embodiments, the raising apparatus may include, for example, a raising device 364 and a plurality of pinned structural members, such as the pinned structural members 366*a*, 366*b*, and 367 shown in FIG. 3E. Depending on the overall design parameters of the collapsible rig substructure 360, the raising device 364 may be any suitable raising/lifting device known in the art, such as, for example, a telescoping hydraulic or pneumatic cylinder apparatus, a screw and/or gear mechanism, and the like. Furthermore, and depending on the desired lifting scheme, the raising device 364 may be pivotably connected at one end to the raisable floor 363*a* and pivotably connected at the other end to a bearing pad support beam 361*b* of the base 361. In other illustrative embodiments, the pinned structural members 366*a* and 366*b* may also be pivotably connected at one end to the raisable floor 363*a* and pivotably connected at the other end to a structural member 365. Additionally, the pinned structural member 367 may be pivotably connected at one end to a bearing pad support beam 361*b* and pivotably connected at the other end to a structural member 365. It should further be appreciated that, in at least some exemplary embodiments, the raising apparatus may include opposing pairs of raising devices 364 and opposing pairs of pinned structural members 366*a*, 336*b* and 367, e.g., wherein substantially similar members of the various pairs are positioned on opposite sides of the raisable substructure 360, as shown in FIGS. 3J and 3M.

In certain illustrative embodiments, the collapsible rig substructure 360 may also include a locking apparatus that is adapted to lock the raisable floor 363*a* in place after it has been raised to an operating position adjacent to the fixed drill floor 363*b*. In some embodiments, the locking apparatus may include, for example, a positioning lug 368 that is fixedly attached to the raisable floor 363*a*, a pin plate 368*p* that is fixedly attached to the fixed drill floor 363*b*, and a locking pin (not shown) that is adapted to pin the positioning lug 368 to the pin plate 368*p*. Additionally, and depending on the required raising scheme and/or the specific design of the raising apparatus, the pinned structural members 366*a* and 366*b* may be adapted so that the raisable floor 363*a* is moved both vertically and laterally as the raising device 364 is actuated to lift the raisable floor 363*a*, and so that the raisable floor 363*a* may be positioned adjacent to the fixed drill floor 363*b*. Furthermore, the positioning lug 368 and the pin plate 368*p* of the locking apparatus may also be sized and positioned so that once the raisable floor 363*a* has been raised to an operating position adjacent to the fixed drill floor 363*b* as described above, a pin hole in the positioning lug 368 may be substantially aligned with a corresponding pin hole in the pin plate 368*p*. Thereafter, the raisable floor 363*a* may be locked in place in the raised operating position by installing the locking pin (not shown) in the substantially aligned pin holes. However, it should be appreciated that other suitably designed locking apparatuses may also be used to lock the raisable floor 363*a* in place adjacent to the fixed drill floor 363*b* after the raisable floor 363*a* has been raised to its operating position.

In other illustrative embodiments, the raising apparatus may be adapted so that the raisable floor 363*a* may be raised in a substantially vertical direction—e.g., without the lateral movement of the raisable floor 363*a* as described above. In such embodiments, structural members (not shown) other than the pinned structural members 366*a* and 366*b* described above may be used that are adapted to support the raisable floor 363*a* with the drawworks skid 370*a* and drawworks 370 positioned thereon (see, FIG. 3G) after the raisable floor 363*a* has been raised into position. Additional locking members (not shown) that may be adapted to maintain and/or hold the raisable floor 363*a* in the desired position, such as the positioning lug 368 and pin plate 368*p*, may also be included. Furthermore, in certain embodiments, additional raising devices (not shown), such as the raising devices 364, may also be used and appropriately located so as to maintain the raisable floor 363*a* in a substantially level condition while the raisable floor 363*a* is being raised.

In at least some embodiments, the base 361 of the collapsible rig substructure 360 may also include a temporary and/or removable rig-up skid 361*a*, which may be adapted to temporarily support the raisable floor 363*a* during transportation over the highway and/or road 305, as well as during the fit-up and assembly of the collapsible rig substructure 360 to the mast assembly structure 320. In certain embodiments, the rig-up skid 361*a* may be removed after the raisable floor 363*a* has been raised to the raised operating position, as shown in FIG. 3G. Additionally, the collapsible rig substructure 360 may include lower connections 362*a* and upper connections 362*b* that may be adapted to facilitate the attachment of the collapsible rig substructure 360 to the mast assembly structure 320, as previously described.

FIG. 3F is a close-up side elevation view of the collapsible rig substructure 360 with the drawworks 370 and drawworks skid 370*a* positioned thereon. Furthermore, a rear portion of the mast assembly structure 320 is shown in FIG. 3F for additional clarity. In certain embodiments, the collapsible rig substructure 360 may be attached to the mast assembly structure 320 by releasably coupling the upper and lower connections 362*b*/362*a*, respectively, on the collapsible rig substructure 360 to the corresponding upper and lower connections 322*a*/322*b*, respectively, on the mast assembly structure 320. Moreover, drilling mats 380 may be positioned on the ground 381 adjacent to a respective wellbore location, and the pad bearing support beams 361*b* may be in bearing contact with the drilling mats 380 so as to support the collapsible rig substructure 360. Additionally, the support jacks 330 may be lowered to contact the drilling mats 380 and thereafter used to raise the trailer 301 so that the wheels 302 are no longer in contact with the ground 381 and/or the drilling mats 380. As shown in FIG. 3F, the raisable floor 363*a* is still in the lowered transportation position, such that the height level of the upper surface of the drawworks skid 370*a* is a distance 370*d* below the height level of the upper surface of the raised drill floor 363*b*.

FIG. 3G shows the illustrative collapsible rig substructure 360 and mast assembly structure 320 of FIG. 3F after the raising apparatus has been actuated so as to raise the raisable floor 363*a* up and into the raised operating position. As shown in the illustrative embodiment depicted in FIG. 3G, the raising device 364 has been extended so as to lift the raisable floor 363*a* from the lowered transportation position by the distance 370*d* (see, FIG. 3F) so that the upper surface of the drawworks skid 370*a* is positioned substantially level with the upper surface of the fixed drill floor 363*b*. Furthermore, the pinned structural members 366*a*, 366*b* have been pivotably rotated so as to move the raisable floor 363*a* into its operating position adjacent to the fixed drill floor 363*b*, and so that the respective holes in the positioning lug 368 and the pin plate 368*p* are properly aligned to accept a locking pin (not shown). As noted previously, it should be appreciated that other types of raising apparatuses may also be used to raise the raisable floor 363*a* to the raised operating position. Additionally, the temporary rig-up skid 361*a* (see, FIG. 3F) has also been removed.

Also as shown in FIG. 3G, the drilling mast 310 has been raised to a substantially vertical operating orientation for drilling operations at a first wellbore location of a respective pad drilling site. Additionally, stiff legs 321, which in certain embodiments may be made up of a lower section 321*a* that is pivotably attached to the trailer 301 and an upper section 321*b* that is fixedly attached to the lower section 321*a*, may be removably attached to the drilling mast 310, as shown, for example, in FIGS. 3H and 3I. Furthermore, wellhead equipment 390, e.g., pressure-retaining wellhead equipment such as a Christmas tree and/or BOP and the like, may be positioned on a wellhead 390*w* and in the cellar 391 of the collapsible rig substructure 360, i.e., below the fixed drill floor 363*b* and the drilling mast 310.

FIG. 3H shows an overall side elevation view of an illustrative mobile drilling rig 395, such as a slant rig and the like, after the drilling mast 310 of the rig 395 has been raised to a substantially vertical operating orientation. Furthermore, FIG. 3H also shows a collapsible rig substructure 360, such as the collapsible rig substructure 360 of FIGS. 3E-3G, which has been raised to an operating position, i.e., wherein the raisable floor 363*a* has been raised and moved to its operating position adjacent to the fixed drill floor 363*b*, and the upper surface of the drawworks skid 370*a* is substantially level with the upper surface of the fixed drill floor 363*b*. FIG. 3I illustrates the mobile drilling rig 395 of FIG. 3H, wherein the mast 310 has been positioned at a non-zero angle relative to horizontal, e.g., 45°, for slant drilling operations. As shown in FIG. 3I, the stiff legs 321 have been have been pivotably rotated from the position illustrated in FIG. 3H and connected to the drilling mast 310 so as to support the mast 310 during the slant drilling operations.

Figure 1E:
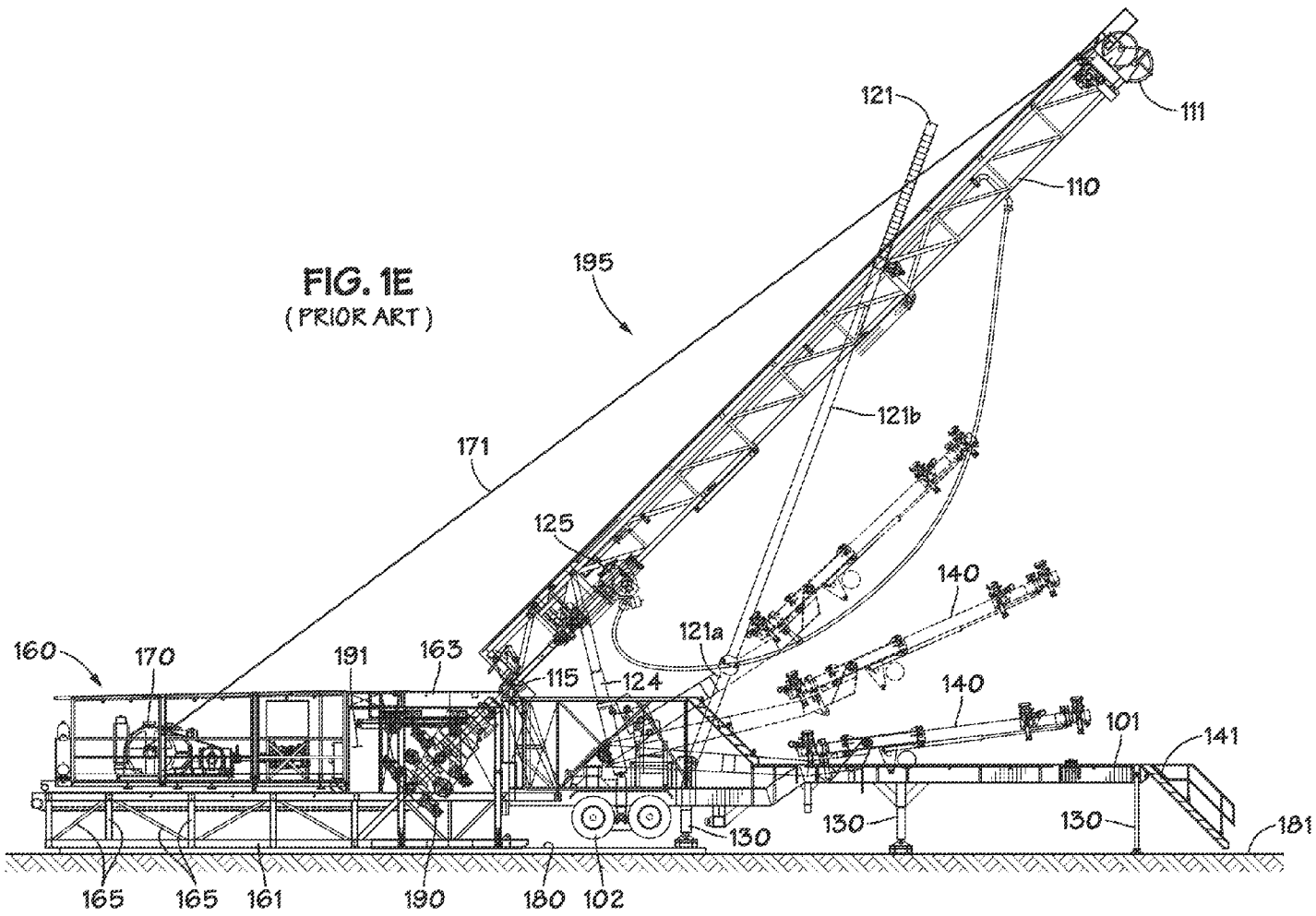
FIG. 1E (PRIOR ART)
FIG. 1E is a side elevation view of the prior art slant rig of FIGS. 1A-1D after erection of the drilling rig mast to an operating position.
Figure 2A:
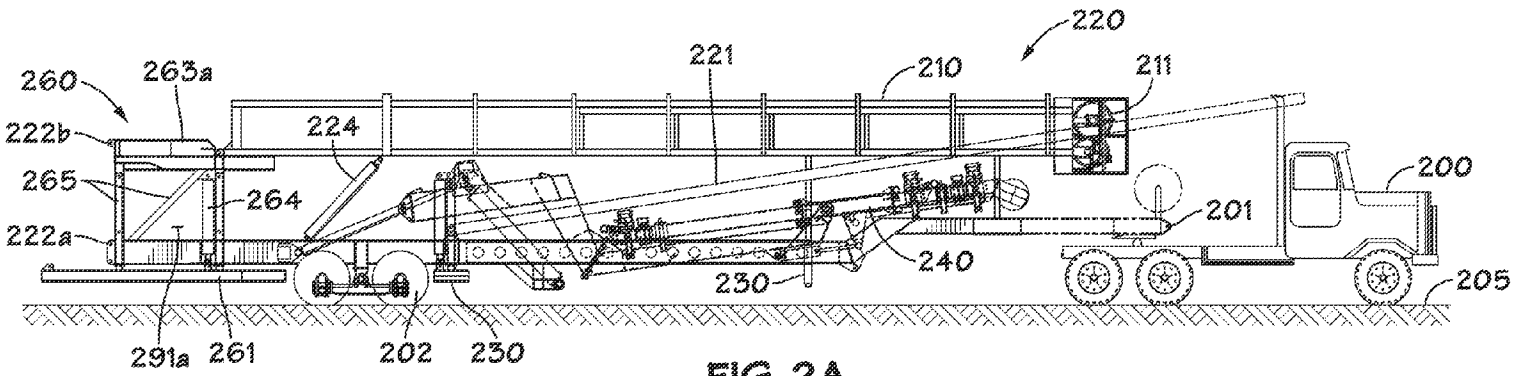
FIG. 2A (PRIOR ART)
FIG. 2A is a side elevation view of a mast assembly structure and rig substructure of another representative prior art slant rig, wherein the mast assembly structure and rig substructure are positioned on a trailer for highway and/or road transportation.
Figure 2B:
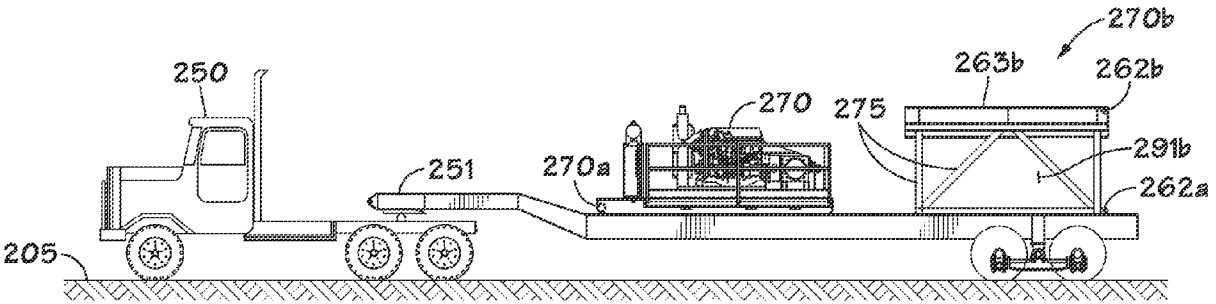
FIG. 2B (PRIOR ART)
FIG. 2B is a side elevation view of a drawworks and drawworks box of the prior art slant rig of FIG. 2A, wherein the drawworks and drawworks box are positioned on a trailer for highway and/or road transportation.
Figure 2C:
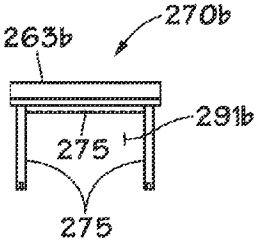
FIG. 2C (PRIOR ART)
FIG. 2C is an end elevation view of the drawworks box of FIG. 2B.
Figure 2D:
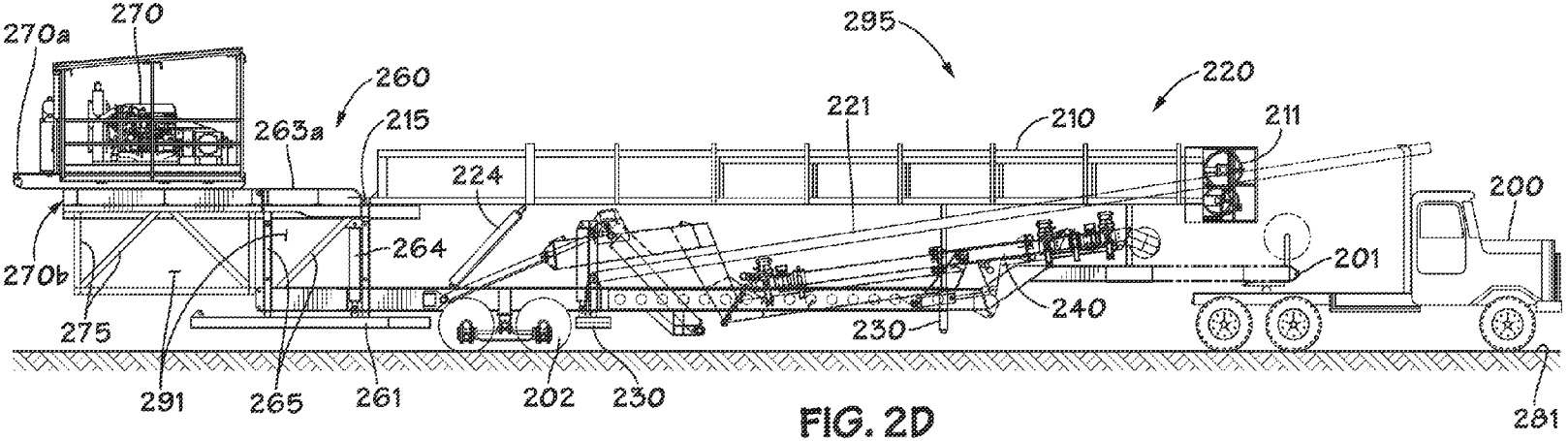
FIG. 2D (PRIOR ART)
FIG. 2D is a side elevation view of the prior art slant rig of FIGS. 2A-2C, after full assembly of the drawworks and drawworks box of FIGS. 2B and 2C to the rig substructure of FIG. 2A, wherein the fully assembled slant rig is positioned for movement between adjacent wellbore locations.

FIG. 3J is an end view of the illustrative collapsible rig substructure 360 of FIG. 3G, showing the wellhead equipment 390 positioned in the cellar 391 of the illustrative collapsible rig substructure 360. In FIG. 3J, the trailer 301 and mast assembly structure 320 have been removed for clarity, and so as to illustrate that the cellar 391 is substantially open on the back side of the collapsible rig substructure 360, i.e., opposite of the mast assembly structure 320 and trailer 301 (see, FIG. 3G). Therefore, unlike the substantially enclosed cellar 191 of the prior art slant rig 195 illustrated in FIG. 1E and described above, the substantially open cellar 391 of the presently disclosed collapsible rig substructure 360 is adapted to enable access to the wellhead equipment 390 for repair and/or maintenance during drilling operations without having to disassemble or remove any of the components of the substructure 360 and/or the mast assembly structure 320. Furthermore, the substantially open cellar 391 also enables the fully assembled mobile drilling rig 395 to be moved over the wellhead equipment 390—i.e., while the wellhead equipment 390 is positioned on the wellhead 390*w*—so that the mobile drilling rig 395 can be moved from the first wellbore location to a second wellbore location of the respective pad drilling site (see, FIG. 3K) where additional drilling activities may be performed. For example, as shown in FIG. 3K, after the drilling mast 310 has been lowered from a specified drilling position—e.g., from a substantially vertical orientation as shown in FIG. 3H or from an angled orientation as shown in FIG. 3I—to a substantially horizontal position, the truck 300 may be used to move the trailer 301 and the mobile drilling rig 395 over the ground 381 of the pad drilling site. In certain illustrative embodiments, additional operations may also be performed so as to prepare the collapsible rig substructure 360 prior to movement of the mobile drilling rig 395 between wellbore locations, as will be described in further detail with respect to FIG. 3L below.

Figure 3L:
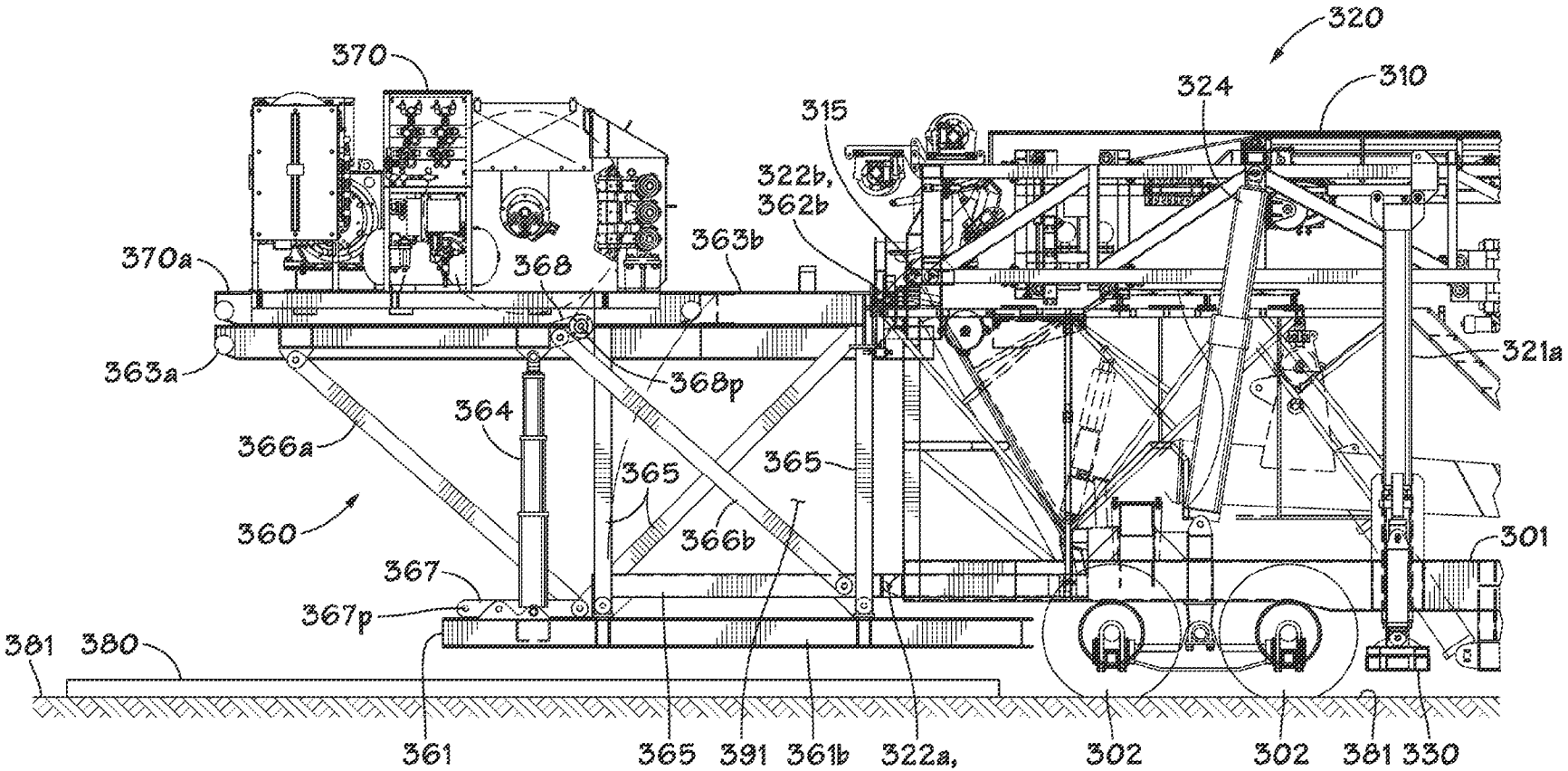
FIG. 3L is a close-up side elevation view of the collapsible rig substructure and drawworks shown in FIG. 3K.
Figure 3M:
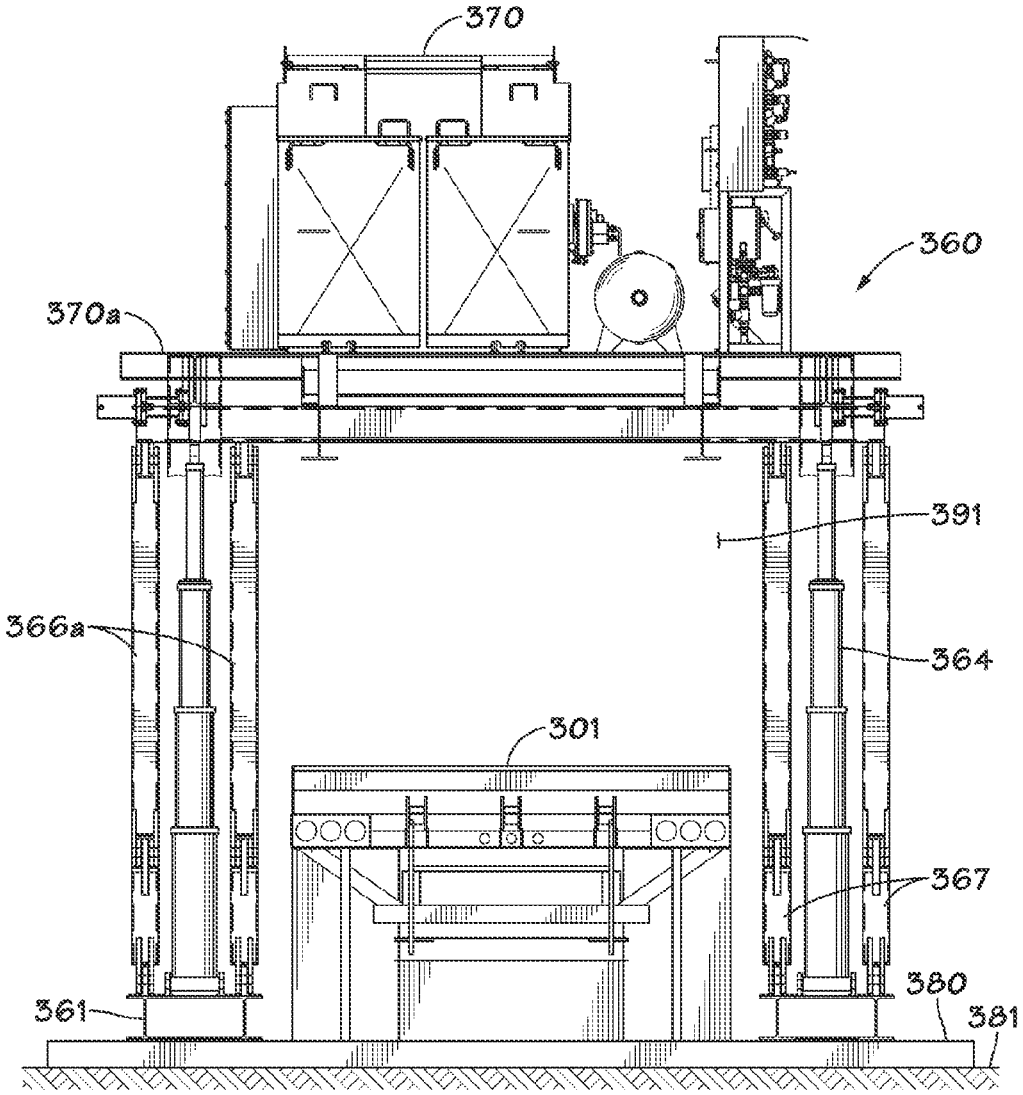
FIG. 3M is an end elevation view of the collapsible rig substructure of FIG. 3K, after the bearing pad support beams of the collapsible rig substructure have been lowered into contact with the drilling surface.

FIG. 3L illustrates a close-up elevation view of the collapsible rig substructure 360 and mast assembly structure 320 of FIG. 3G after drilling activities have been completed at a first wellbore location and the assembled mobile drilling rig 395 has been moved to a second wellbore location, where additional drilling activities may be performed. As shown in FIG. 3L (see also, FIG. 3K), the drilling mast 310 has been lowered to a substantially horizontal position for movement over wellhead equipment 390 at the first wellbore location and between the first and second wellbore locations by disconnecting the stiff legs 321 (see, FIGS. 3H and 3I) from the mast 310 by actuating the raising apparatus 324 so as to pivotably rotate the mast 310 about the pinned connection 315.

In certain exemplary embodiments, after the drilling mast 310 has been lowered as described above, the bearing pad support beams 361*b* of the base 361 may then be retracted by unpinning a lower end 367*p* of the pinned structural members 367 from the bearing pad support beams 361*b* and actuating the raising device 364 so as to lift the bearing pad support beams 361*b* away from the drilling mats 380. Furthermore, in some embodiments, the structural members 369 (see, FIGS. 3E and 3G) may be adapted so that they can removed from the collapsible rig substructure 360, thereby enabling the bearing pad support beams 361*b* to be raised. In other embodiments, the structural members 369 may be adapted so that they can be unpinned at an upper end thereof from the structural members 365, and so that the structural members 369 may collapsibly slide into the structural members 365 as the raising device 364 is actuated. It should be appreciated, however, that other means may also be used to facilitate the retraction of the bearing pad support beams 361*b* prior to moving the assembled mobile drilling rig 395 between wellbore locations of a given pad drilling site. Thereafter, the truck 300 may be positioned under and hitched to the trailer 301 (see, FIG. 3K), and the support jacks 330 may be retracted until the trailer 301 is lowered and the wheels 302 contact the drilling mats 380 and/or the ground 381, thereby enabling the mobile drilling rig 395 to be moved.

FIG. 3M illustrates an end view of the collapsible rig substructure 360 and mast assembly structure 320 of FIG. 3L wherein the assembled mobile drilling rig 395 (see, FIG. 3K) has been positioned at the second wellbore location of the respective pad drilling site, and the bearing pad support beams 361*b* have been lowered so as to once again be put into bearing contact the drilling mats 380. For clarity, the mast assembly structure 320 has been removed from FIG. 3M so as to illustrate the substantially open cellar 391 of the collapsible rig substructure 360, which enables the mobile drilling rig 395 to be moved into position at the second wellbore location. Furthermore, it should be appreciated that wellhead equipment, such as the wellhead equipment 390 shown in FIG. 3J, may already be positioned above a wellhead 390*w* at the second wellbore location. However, the substantially open cellar 391 of the collapsible rig substructure 360 readily facilitates movement of the mobile drilling rig 395 over any wellhead equipment at the second wellbore location and into position for drilling operations. Thereafter, the drilling mast 310 of the mobile drilling rig 395 may be raised into an appropriate position for wellbore drilling operations, as illustrated in FIG. 3H (i.e., with the mast 310 in a substantially vertical orientation) or FIG. 3I (i.e., with the mast 310 in an angled orientation relative to horizontal for slant drilling).

As may be required by the specific circumstances surrounding the movement of the presently disclosed collapsible rig substructure 360 between different wellbore locations of a respective pad drilling site, it may be necessary to position the raisable floor 363*a* in an intermediate movement position that is between the lowered transportation position illustrated in FIG. 3F and the raised operating position shown in FIGS. 3G and 3L. For example, depending on the weight of the drawworks 370 and the position of the drawworks 370 relative to the center of gravity (CG) of the assembled mobile drilling rig 395 during movement around a pad drilling site, it may sometimes be necessary to lower the raisable floor 363*a* and the drawworks 370 positioned thereon so as to ensure the overall stability of the rig 395 while it is being moved. Accordingly, as the overall height of the wellhead equipment 390 may permit, the raisable floor 363*a* may be adapted to be lowered to an intermediate movement position below the raised operating position and above the lowered transportation position while still providing a substantially open cellar 391 that is adequately sized to facilitate movement of the assembled mobile drilling rig 395 between wellbore locations. Furthermore, it should be appreciated that when the collapsible rig substructure 360 is configured substantially as illustrated in FIG. 3E, a temporary pinned structural member (not shown) of appropriate size and length that is adapted to maintain the raisable floor 363*a* in the intermediate movement position below the raised operating position may be installed with appropriately sized locking pins (not shown) between the positioning lug 368 and the pin plate 368*p*, so as to lock the raisable floor 363*a* in the intermediate movement position.

It should be further appreciated that the raisable floor 363*a* of the collapsible rig substructure 360 may also be positioned in an intermediate movement position as described above during highway and/or road transportation of the collapsible rig substructure 360, as may depend on the overall size and weight parameters of the collapsible rig substructure 360 and the drawworks 370, as well as the various restrictions and permitting requirements that may be imposed during equipment transportation.

As a result, the subject matter of the present disclosure provides details of various aspects of a collapsible rig substructure of a mobile drilling rig that can be lowered to a lowered transportation position for transportation over highways and/or roads to an oilfield drilling site. In certain embodiments, a drawworks may be positioned on the collapsible rig substructure while the substructure is in a lowered transportation position, so that the drawworks can be simultaneously transported with the collapsible rig substructure to the drilling site. Additionally, embodiments of the collapsible rig substructure disclosed herein may also be attached to a mast assembly structure of the mobile drilling rig, and a raisable floor of the collapsible rig substructure may be raised to a raised operating position with a drawworks positioned thereon. Furthermore, in at least some embodiments of the present disclosure, at least a portion of the collapsible rig substructure may be retracted while the raisable floor is in a raised operating position so as to enable movement of the assembled mobile drilling rig between various wellbore locations of a respective pad drilling site.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

transporting a collapsible drilling rig substructure to a drilling site while said collapsible drilling rig substructure is in a collapsed transportation configuration, wherein a raisable floor of said collapsible drilling rig substructure is in a lowered transportation position relative to a fixed drill floor of said collapsible drilling rig substructure such that an upper surface of said raisable floor is positioned at a first height level above a base of said collapsible drilling rig substructure while an upper surface of said fixed drill floor is positioned at a second height level above said base that is greater than said first height level;

positioning said collapsible drilling rig substructure adjacent to a wellbore location at said drilling site so that a bearing pad support beam comprising said base is supporting said collapsible drilling rig substructure;

performing a first reconfiguration operation to reconfigure said collapsible drilling rig substructure from said lowered transportation configuration to a raised operating configuration, wherein said first reconfiguration operation comprises raising said raisable floor from said lowered transportation position to an operating position laterally adjacent to said fixed drill floor while maintaining a height level of said upper surface of said fixed drill floor at said second height level above said base: and performing a second reconfiguration operation to reconfigure said collapsible drilling rig substructure from said raised operating configuration to a substructure movement configuration, wherein said second reconfiguration operation comprises raising said bearing pad support beam relative to said fixed drill floor and said raisable floor so that said bearing pad support beam is no longer supporting said collapsible drilling rig substructure while maintaining said raisable floor in said operating position laterally adjacent to said fixed drill floor.

2. The method of claim 1, further comprising, after positioning said collapsible drilling rig substructure adjacent to said wellbore location, positioning a drawworks on said raisable floor while said raisable floor is positioned in said lowered transportation position, wherein raising said raisable floor to said operating position adjacent to said fixed drill floor comprises raising said raisable floor with said drawworks positioned thereon.

3. The method of claim 1, further comprising, after performing said first reconfiguration operation, performing a drilling operation on said wellbore location while said collapsible drilling rig substructure is in said raised operating configuration.

4. The method of claim 3, wherein said wellbore location is a first wellbore location and said drilling operation is a first drilling operation, the method further comprising:

after performing said first drilling operation on said first wellbore location, performing said second reconfiguration operation;

moving said collapsible drilling rig substructure from above a wellhead at said first wellbore location while said collapsible drilling rig substructure is in said substructure movement configuration;

positioning said collapsible drilling rig substructure adjacent to a second wellbore location;

after positioning said collapsible drilling rig substructure adjacent to said second wellbore location, performing a third reconfiguration operation to reconfigure said collapsible drilling rig substructure from said substructure movement configuration to said raised operating configuration; and performing a second drilling operation on said second wellbore location while said collapsible drilling rig substructure is in said raised operating configuration.

5. The method of claim 4, wherein performing said third reconfiguration operation comprises lowering said bearing pad support beam relative to said fixed drill floor and said raisable floor while maintaining said raisable floor with said drawworks positioned thereon in said operating position laterally adjacent to said fixed drill floor.

6. The method of claim 4, wherein moving said collapsible drilling rig substructure from above said wellhead at said first wellbore location comprises moving said collapsible drilling rig substructure laterally over wellhead equipment that is positioned on said wellhead while said raisable floor is in said operating position laterally adjacent to said fixed drill floor.

7. The method of claim 6, wherein moving said collapsible drilling rig substructure laterally over said wellhead equipment comprises moving said collapsible drilling rig substructure so that said wellhead equipment passes laterally through a cellar area of said collapsible drilling rig substructure and out of said cellar area through an open space defined by at least said raisable floor and said base.

8. The method of claim 1, wherein performing said drilling operation on said wellbore location comprises coupling a mast assembly structure to said collapsible drilling rig substructure and pivotably raising a drilling mast of said mast assembly structure above said collapsible drilling rig structure.

9. A method, comprising:

positioning a raisable floor of a drilling rig substructure in a lowered transportation position relative to a fixed drill floor of said drilling rig substructure such that an upper surface of said raisable floor is positioned at a first height level above a base of said drilling rig substructure while an upper surface of said fixed drill floor is positioned at a second height level above said base that is greater than said first height level;

positioning a drawworks on said raisable floor of said drilling rig substructure while said raisable floor is in said lowered transportation position;

transporting said drilling rig substructure with said drawworks positioned on said raisable floor to a drilling site while said raisable floor is in said lowered transportation position;

positioning said drilling rig substructure adjacent to a wellbore location at said drilling site so that a bearing pad support beam comprising said base is supporting said drilling rig substructure;

raising said raisable floor with said drawworks positioned thereon from said lowered transportation position to an operating position adjacent to said fixed drill floor such that said upper surface of said raisable floor is at an operating height level above said base for performing drilling operations that is substantially the same as said second height level of said upper surface of said fixed drill floor;

after raising said raisable floor, performing a drilling operation at said wellbore location; and after performing said drilling operation and while maintaining said raisable floor with said drawworks positioned thereon in said operating position laterally adjacent to said fixed drill floor, raising said bearing pad support beam relative to said fixed drill floor and said raisable floor so that said bearing pad support beam is no longer supporting said drilling rig substructure.

10. The method of claim 9, wherein raising said raisable floor of said drilling rig substructure to said operating position adjacent to said fixed drill floor comprises actuating a raising apparatus that is coupled to at least said raisable floor and said base.

11. The method of claim 10, further comprising:

positioning a mast assembly structure adjacent to said drilling rig substructure, said mast assembly structure comprising a pivotably mounted drilling mast that is in a substantially horizontal orientation during said positioning of said mast assembly structure;

assembling said mast assembly structure and said drilling rig substructure into a drilling rig assembly by removably coupling said mast assembly structure to said drilling rig substructure;

pivotably rotating said drilling mast to a raised operating position above said fixed drill floor; and performing said drilling operation at said wellbore location with said drilling rig assembly.

12. The method of claim 11, further comprising, after raising said bearing pad support beam, moving said drilling rig assembly from above a wellhead at said wellbore location.

13. The method of claim 12, wherein moving said drilling rig assembly from above said wellhead comprises moving said drilling rig substructure laterally over wellhead equipment that is positioned on said wellhead while said raisable floor is in said operating position adjacent to said fixed drill floor.

14. The method of claim 13, wherein moving said drilling rig substructure laterally over said wellhead equipment comprises moving said drilling rig substructure so that said wellhead equipment passes laterally through a cellar area of said drilling rig substructure and out of said cellar area through an open space defined by at least said raisable floor and said base.

15. The method of claim 10, wherein raising said bearing pad support beam relative to said fixed drill floor and said raisable floor comprises actuating said raising apparatus.

16. A method, comprising:

positioning a collapsible drilling rig substructure adjacent to a first wellbore location of a pad drilling site, said collapsible drilling rig substructure comprising a base, a fixed drill floor, and a raisable floor that is raisable relative to said base and said fixed drill floor, wherein positioning said collapsible drilling rig substructure adjacent to said first wellbore location comprises lowering a bearing pad support beam comprising said base into bearing contact with one of ground and a drilling mat adjacent to said first wellbore location so that said bearing pad support beam supports said collapsible drilling rig substructure;

after positioning said collapsible drilling rig substructure adjacent to said first wellbore location, raising said bearing pad support beam relative to each of said fixed drill floor, said raisable floor, and said one of said ground and said drilling mat so that said bearing pad support beam is no longer in contact with said one of said ground and said drilling mat and is no longer supporting said collapsible drilling rig substructure; and moving said collapsible drilling rig substructure away from said first wellbore location and positioning said collapsible drilling rig substructure adjacent to a second wellbore location of said pad drilling site.

17. The method of claim 16, wherein, prior to positioning said collapsible drilling rig substructure adjacent to said first wellbore location, said raisable floor is in a lowered transportation position relative to said fixed drill floor such that an upper surface of said raisable floor is positioned at a first height level above said base while an upper surface of said fixed drill floor is positioned at a second height level above said base that is greater than said first height level, the method further comprising, after positioning said collapsible drilling rig substructure adjacent to said first wellbore location and prior to raising said bearing pad support beam, raising said raisable floor from said lowered transportation position to an operating position laterally adjacent to said fixed drill floor while maintaining a height level of said upper surface of said fixed drill floor at said second height level above said base.

18. The method of claim 16, further comprising, after positioning said collapsible drilling rig substructure adjacent to said first wellbore location and prior to raising said bearing pad support beam:

positioning a mast assembly structure adjacent to said collapsible drilling rig substructure, wherein said mast assembly structure is supported by a trailer and comprises a drilling mast;

assembling said mast assembly structure and said collapsible drilling rig substructure into a drilling rig assembly by removably coupling said mast assembly structure to said collapsible drilling rig substructure; and performing a drilling operation at said first wellbore location with said drilling rig assembly.

19. The method of claim 18, wherein, after raising said bearing pad support beam, said assembled drilling rig assembly are supported by said trailer.

20. The method of claim 18, further comprising using said trailer to move said assembled drilling rig assembly away from said first wellbore location and to position said assembled drilling rig assembly adjacent to said second wellbore location.

* * * * *